US008385797B2

(12) United States Patent
Ogawa et al.

(10) Patent No.: US 8,385,797 B2
(45) Date of Patent: Feb. 26, 2013

(54) FIXING DEVICE AND IMAGE FORMING APPARATUS INCORPORATING SAME

(75) Inventors: Tadashi Ogawa, Machida (JP); Masanao Ehara, Zama (JP); Kenji Ishii, Kawasaki (JP); Satoshi Ueno, Komae (JP); Hiroshi Seo, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 362 days.

(21) Appl. No.: 12/662,991

(22) Filed: May 14, 2010

(65) Prior Publication Data

US 2010/0303521 A1 Dec. 2, 2010

(30) Foreign Application Priority Data

May 27, 2009 (JP) ..... 2009-127541

(51) Int. Cl.
*G03G 15/20* (2006.01)

(52) U.S. Cl. ..... 399/323

(58) Field of Classification Search ..... 399/320, 399/322, 323, 328, 337, 338
See application file for complete search history.

(56) References Cited

U.S. PATENT DOCUMENTS

| | | | |
|---|---|---|---|
| 5,400,123 | A | 3/1995 | Sato et al. |
| 5,832,354 | A | 11/1998 | Kouno et al. |
| 5,915,147 | A | 6/1999 | Kouno et al. |
| 6,219,520 | B1 | 4/2001 | Ehara |
| 6,628,916 | B2 | 9/2003 | Yasui et al. |
| 6,636,709 | B2 | 10/2003 | Furukawa et al. |
| 6,778,790 | B2 | 8/2004 | Yoshinaga et al. |
| 6,785,505 | B2 | 8/2004 | Yasui et al. |
| 6,807,386 | B2 | 10/2004 | Yasui et al. |
| 6,813,464 | B2 | 11/2004 | Amita et al. |
| 6,881,927 | B2 | 4/2005 | Yoshinaga et al. |
| 6,892,044 | B2 | 5/2005 | Yasui et al. |
| 6,937,827 | B2 | 8/2005 | Katoh et al. |
| 7,022,944 | B2 | 4/2006 | Yoshinaga et al. |
| 7,266,336 | B2 | 9/2007 | Ueno et al. |
| 7,450,872 | B2 | 11/2008 | Ueno et al. |
| 7,491,917 | B2 | 2/2009 | Ueno |
| 7,509,085 | B2 | 3/2009 | Yoshinaga et al. |
| 7,546,049 | B2 | 6/2009 | Ehara et al. |
| 7,570,910 | B2 | 8/2009 | Ishii |
| 7,890,017 | B2 | 2/2011 | Naitoh et al. |
| 2002/0018663 | A1 | 2/2002 | Furukawa et al. |
| 2002/0067936 | A1 | 6/2002 | Yasui et al. |
| 2002/0164172 | A1 * | 11/2002 | Tsubaki et al. ..... 399/45 |

(Continued)

FOREIGN PATENT DOCUMENTS

| | | | |
|---|---|---|---|
| JP | 08016023 | A * | 1/1996 |
| JP | 2006-011193 | | 1/2006 |

(Continued)

*Primary Examiner* — Walter L Lindsay, Jr.
*Assistant Examiner* — Barnabas Fekete
(74) *Attorney, Agent, or Firm* — Harness, Dickey & Pierce, P.L.C.

(57) ABSTRACT

In a fixing device, a second rotary member disposed opposite a first rotary member forms a nip between the first rotary member and the second rotary member through which a recording medium bearing a toner image passes. A first separation member rotatively provided on a rotary shaft of the first rotary member separates the recording medium passing through the nip from the first rotary member. A rotation angle adjuster connected to the first separation member changes a rotation angle position of the first separation member.

30 Claims, 8 Drawing Sheets

U.S. PATENT DOCUMENTS

2003/0000933 A1 1/2003 Yoshinaga et al.
2003/0007813 A1 1/2003 Yasui et al.
2003/0016963 A1 1/2003 Yoshinaga et al.
2003/0165348 A1 9/2003 Amita et al.
2003/0206758 A1 11/2003 Yasui et al.
2004/0042825 A1 3/2004 Yasui et al.
2005/0008409 A1* 1/2005 Kurisu ..... 399/323
2005/0074251 A1 4/2005 Katoh et al.
2005/0095043 A1 5/2005 Yoshinaga et al.
2005/0191098 A1 9/2005 Ueno et al.
2006/0029411 A1 2/2006 Ishii et al.
2006/0165443 A1 7/2006 Yoshinaga et al.
2006/0257183 A1 11/2006 Ehara et al.
2006/0285893 A1 12/2006 Ishii
2006/0289419 A1 12/2006 Ueno
2007/0003334 A1 1/2007 Shinshi et al.
2007/0014600 A1 1/2007 Ishii et al.
2007/0059003 A1 3/2007 Shinshi et al.
2007/0059011 A1 3/2007 Seo et al.
2007/0201916 A1 8/2007 Ueno
2007/0212089 A1 9/2007 Seo et al.
2007/0242988 A1 10/2007 Seo et al.
2007/0264060 A1 11/2007 Ueno et al.
2007/0280754 A1 12/2007 Ogawa et al.
2008/0025772 A1 1/2008 Seo et al.
2008/0025773 A1 1/2008 Ito et al.
2008/0044196 A1 2/2008 Seo et al.
2008/0063443 A1 3/2008 Yoshinaga et al.
2008/0219721 A1 9/2008 Ito et al.
2008/0226326 A1 9/2008 Seo et al.
2008/0232873 A1 9/2008 Ueno et al.
2008/0317532 A1 12/2008 Ehara et al.
2009/0010680 A1 1/2009 Nanno
2009/0060550 A1 3/2009 Seo
2009/0060572 A1 3/2009 Naitoh et al.
2009/0074440 A1 3/2009 Nanno et al.
2009/0110449 A1 4/2009 Saito et al.
2009/0123201 A1 5/2009 Ehara et al.
2009/0129836 A1 5/2009 Sakaya et al.
2009/0148204 A1 6/2009 Yoshinaga et al.
2009/0148205 A1 6/2009 Seo et al.
2009/0245897 A1 10/2009 Seo et al.
2010/0074667 A1 3/2010 Ehara et al.
2010/0158553 A1 6/2010 Ueno

FOREIGN PATENT DOCUMENTS

JP 2007-232877 9/2007

* cited by examiner

FIXING DEVICE AND IMAGE FORMING APPARATUS INCORPORATING SAME

PRIORITY STATEMENT

The present patent application claims priority from Japanese Patent Application No. 2009-127541, filed on May 27, 2009 in the Japan Patent Office, which is hereby incorporated herein by reference in its entirety.

BACKGROUND OF THE INVENTION

1. Field of the Invention

Example embodiments generally relate to a fixing device and an image forming apparatus, and more particularly, to a fixing device for fixing a toner image on a recording medium and an image forming apparatus including the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges the surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then collects residual toner not transferred and remaining on the surface of the image carrier after the toner image is transferred from the image carrier onto the recording medium; finally, a fixing device applies heat and pressure to the recording medium bearing the toner image to fix the toner image on the recording medium, thus forming the image on the recording medium.

Such fixing device may include a fixing roller and a pressing roller pressing against each other to form a nip therebetween. As a recording medium bearing a toner image passes through the nip, the fixing roller applies heat to the recording medium to melt the toner image and fix it on the recording medium. However, it can happen that the melted toner, which contains resin to facilitate melting, may move to the fixing roller contacting the toner image on the recording medium during fixing. Consequently, the melted toner adhered to the fixing roller may wind the recording medium around the fixing roller. Moreover, when a toner image is formed on both sides of the recording medium by duplex printing, the heated toner on the back side of the recording medium contacting the pressing roller also may wind the recording medium around the pressing roller.

To address this problem, a pawl-shaped or plate-shaped separation member may be disposed opposite the fixing roller or the pressing roller to separate the recording medium from the fixing roller or the pressing roller.

In addition, a slight gap of predetermined size is generally retained between a front edge portion of the separation member and the surface of the fixing roller or the pressing roller to improve the ability of the separation member to separate the recording medium from the fixing roller or the pressing roller.

Further, the front edge portion of the separation member is disposed closer to the nip to improve the performance of the separation member. For example, when relatively thin paper is used as a recording medium, the front edge portion of the separation member needs to be closer to the nip than when relatively thick paper is used. However, the front edge portion of the separation member disposed closer to the nip may scratch the toner image on the recording medium passing through the nip, resulting in formation of the streaked toner image. Alternatively, the toner on the recording medium may adhere to the front edge portion of the separation member and then adhere to the recording medium again, staining the recording medium. Moreover, when the recording medium is jammed between the fixing roller and the pressing roller, the front edge portion of the separation member disposed closer to the nip may hinder manual removal of the recording medium.

SUMMARY

At least one embodiment may provide a fixing device that includes a first rotary member, a second rotary member, a first separation member, and a rotation angle adjuster. The second rotary member is disposed opposite the first rotary member to form a nip between the first rotary member and the second rotary member through which a recording medium bearing a toner image passes. The first separation member is rotatively provided on a rotary shaft of the first rotary member to separate the recording medium passing through the nip from the first rotary member. The rotation angle adjuster is connected to the first separation member to change a rotation angle position of the first separation member.

At least one embodiment may provide an image forming apparatus for forming a toner image on a recording medium that includes the fixing device described above.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
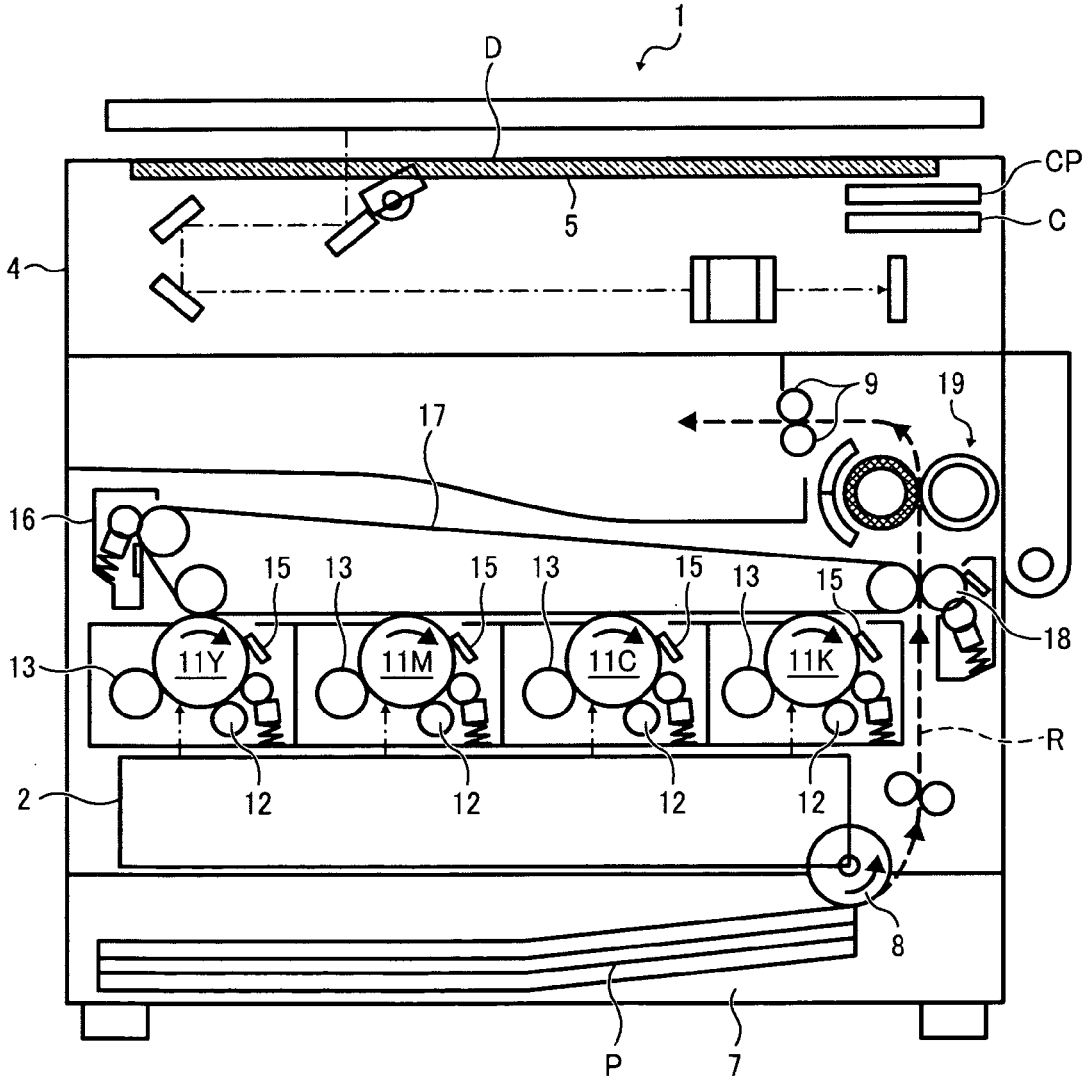
FIG. 1 is a schematic view of an image forming apparatus according to an example embodiment.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 1 according to an example embodiment is explained.

FIG. 1 is a schematic view of the image forming apparatus 1. As illustrated in FIG. 1, the image forming apparatus 1 includes a writer 2, a reader 4, an exposure glass 5, a paper tray 7, a feed roller 8, an output roller pair 9, photoconductive drums 11Y, 11M, 11C, and 11K, chargers 12, development devices 13, cleaners 15, a belt cleaner 16, an intermediate transfer belt 17, a second transfer roller 18, a fixing device 19, a controller C, a recording medium type detector CP, and a conveyance path R.

The image forming apparatus 1 may be a copier, a facsimile machine, a printer, a multifunction printer having at least one of copying, printing, scanning, and facsimile functions, or the like. According to this example embodiment, the image forming apparatus 1 functions as a tandem color copier for forming a color image on a recording medium. However, the image forming apparatus 1 is not limited to the color copier and may form a color and/or monochrome image with other structure.

The reader 4 reads an image on an original document D to generate image data. The chargers 12 charge surfaces of the photoconductive drums 11Y, 11M, 11C, and 11K, respectively. The writer 2 emits laser beams onto the charged surfaces of the photoconductive drums 11Y, 11M, 11C, and 11K according to the image data generated by the reader 4 to form electrostatic latent images, respectively. The development devices 13 make the electrostatic latent images formed on the photoconductive drums 11Y, 11M, 11C, and 11K visible as yellow, magenta, cyan, and black toner images, respectively. Thus, the photoconductive drums 11Y, 11M, 11C, and 11K serve as image carriers for carrying the yellow, magenta, cyan, and black toner images, respectively.

The yellow, magenta, cyan, and black toner images are transferred and superimposed onto the intermediate transfer belt 17 to form a color toner image. The cleaners 15 collect residual toner not transferred and therefore remaining on the photoconductive drums 11Y, 11M, 11C, and 11K from the photoconductive drums 11Y, 11M, 11C, and 11K, respectively. The paper tray 7 loads recording media P such as paper. The second transfer roller 18 transfers the color toner image formed on the intermediate transfer belt 17 onto a recording medium P sent from the paper tray 7. The belt cleaner 16 cleans the intermediate transfer belt 17 after the color toner image is transferred onto the recording medium P. The fixing device 19 fixes the color toner image, that is, an unfixed toner image, on the recording medium P by electromagnetic induction heating.

The following describes operations of the image forming apparatus 1 for forming a color image.

The reader 4 optically reads an image on an original document D placed on the exposure glass 5. Specifically, light emitted by a lamp irradiates and scans the image on the original document D placed on the exposure glass 5. The light reflected by the original document D enters a color sensor through mirrors and lenses to form an image on the color sensor. The color sensor resolves the image into image data corresponding to separation colors, that is, red, green, and blue, and then converts the image data into an electrical image signal. An image processor performs processing such as color conversion processing, color correction processing, and space frequency correction processing based on the electrical image signal to generate yellow, magenta, cyan, black image data. The yellow, magenta, cyan, and black image data is sent to the writer 2. The writer 2 emits laser beams (e.g., exposure light) onto the photoconductive drums 11Y, 11M, 11C, and 11K according to the yellow, magenta, cyan, and black image data, respectively.

The four photoconductive drums 11Y, 11M, 11C, and 11K rotate clockwise in FIG. 1. In a charging process, the chargers 12 uniformly charge the surfaces of the photoconductive drums 11Y, 11M, 11C, and 11K which oppose the chargers 12, respectively, to generate a charging potential on the photoconductive drums 11Y, 11M, 11C, and 11K. When the charged surfaces of the photoconductive drums 11Y, 11M, 11C, and 11K reach irradiation positions at which the charged surfaces of the photoconductive drums 11Y, 11M, 11C, and 11K oppose the writer 2, four light sources of the writer 2 emit laser beams corresponding to the yellow, magenta, cyan, and black image data, respectively, in an exposure process. The laser beams corresponding to the yellow, magenta, cyan, and black image data pass through different optical paths, respectively.

The laser beam corresponding to the yellow image data irradiates the surface of the first photoconductive drum 11Y from the left in FIG. 1. Specifically, a polygon mirror rotating at high speed causes the laser beam corresponding to the yellow image data to scan the photoconductive drum 11Y in an axial direction of the photoconductive drum 11Y, that is, in a main scanning direction. Thus, an electrostatic latent image corresponding to the yellow image data is formed on the surface of the photoconductive drum 11Y charged by the charger 12.

Similarly, the laser beam corresponding to the magenta image data irradiates the surface of the second photoconductive drum 11M from the left in FIG. 1 to form an electrostatic latent image corresponding to the magenta image data. The laser beam corresponding to the cyan image data irradiates the surface of the third photoconductive drum 11C from the left in FIG. 1 to form an electrostatic latent image corresponding to the cyan image data. The laser beam corresponding to the black image data irradiates the surface of the fourth photoconductive drum 11K from the left in FIG. 1 to form an electrostatic latent image corresponding to the black image data.

When the surfaces of the photoconductive drums 11Y, 11M, 11C, and 11K bearing the electrostatic latent images reach development positions at which the surfaces of the photoconductive drums 11Y, 11M, 11C, and 11K bearing the electrostatic latent images oppose the development devices 13, respectively, the development devices 13 supply yellow, magenta, cyan, and black toner to the photoconductive drums 11Y, 11M, 11C, and 11K to make the electrostatic latent images formed on the photoconductive drums 11Y, 11M, 11C, and 11K visible as yellow, magenta, cyan, and black toner images, respectively, in a development process.

When the surfaces of the photoconductive drums 11Y, 11M, 11C, and 11K after the development process reach first transfer positions at which the surfaces of the photoconductive drums 11Y, 11M, 11C, and 11K oppose transfer bias rollers contacting an inner circumferential surface of the intermediate transfer belt 17, respectively, via the intermediate transfer belt 17, the transfer bias rollers successively transfer and superimpose the yellow, magenta, cyan, and black toner images formed on the photoconductive drums 11Y, 11M, 11C, and 11K onto the intermediate transfer belt 17 to form a color toner image on the intermediate transfer belt 17 in a first transfer process.

When the surfaces of the photoconductive drums 11Y, 11M, 11C, and 11K after the first transfer process reach cleaning positions at which the surfaces of the photoconductive drums 11Y, 11M, 11C, and 11K oppose the cleaners 15, respectively, the cleaners 15 collect residual toner not transferred and therefore remaining on the photoconductive drums 11Y, 11M, 11C, and 11K, respectively, in a cleaning process. Thereafter, dischargers discharge the surfaces of the photoconductive drums 11Y, 11M, 11C, and 11K, respectively, to finish a series of image forming processes performed on the photoconductive drums 11Y, 11M, 11C, and 11K.

When the color toner image formed on the intermediate transfer belt 17 reaches a second transfer position at which the color toner image on the intermediate transfer belt 17 opposes the second transfer roller 18, that is, a second transfer nip formed between the second transfer roller 18 and a second transfer backup roller via the intermediate transfer belt 17, the second transfer roller 18 transfers the color toner image formed on the intermediate transfer belt 17 onto a recording medium P conveyed to the second transfer nip in a second transfer process.

For example, the feed roller 8 feeds a recording medium P placed in the paper tray 7 provided in a lower portion of the image forming apparatus 1 toward a registration roller pair through the conveyance path R in which the feed roller 8 and the registration roller pair are provided. The registration roller pair feeds the recording medium P toward the second transfer nip formed between the second transfer roller 18 and the second transfer backup roller via the intermediate transfer belt 17.

Specifically, the paper tray 7 loads a plurality of recording media P. The feed roller 8 rotates counterclockwise in FIG. 1 to feed an uppermost recording medium P toward the conveyance path R. The registration roller pair, which does not rotate, temporarily stops the recording medium P conveyed in the conveyance path R at a roller nip of the registration roller pair. The registration roller pair resumes rotating to convey the recording medium P toward the second transfer nip at a proper time at which the color toner image on the intermediate transfer belt 17 is transferred onto the recording medium P. When the recording medium P reaches the second transfer nip, the second transfer roller 18 transfers the color toner image formed on the intermediate transfer belt 17 onto the recording medium P. Thus, the desired color toner image is formed on the recording medium P.

After the second transfer process, residual toner not transferred onto the recording medium P remains on the intermediate transfer belt 17.

When an outer circumferential surface of the intermediate transfer belt 17 from which the color toner image is transferred onto the recording medium P reaches a cleaning position at which the intermediate transfer belt 17 opposes the belt cleaner 16, the belt cleaner 16 collects the residual toner remaining on the intermediate transfer belt 17. Thus, a series of transfer processes performed on the intermediate transfer belt 17 is finished.

When the recording medium P bearing the color toner image reaches the fixing device 19, the fixing device 19 applies heat and pressure to the recording medium P to fix the color toner image on the recording medium P in a fixing process. The output roller pair 9 discharges the recording medium P bearing the fixed color toner image onto an outside of the image forming apparatus 1 in a direction illustrated by a broken-line arrow. Thus, a series of image forming processes is finished.

Figure 2:
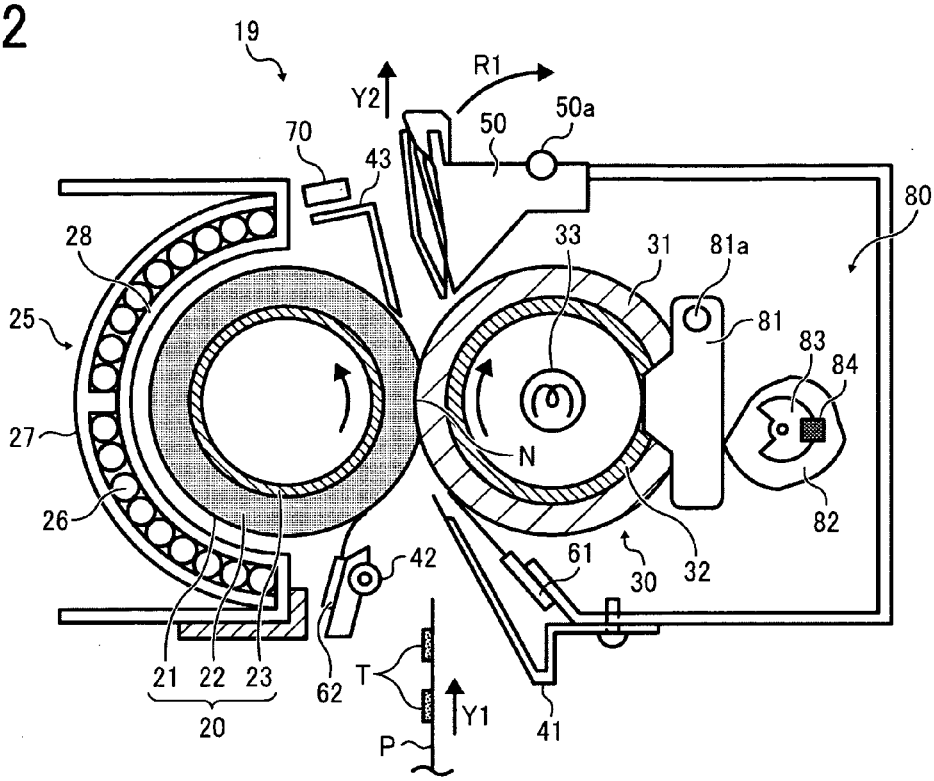
FIG. 2 is a sectional view (according to an example embodiment) of a fixing device included in the image forming apparatus shown in FIG. 1.

Referring to FIG. 2, the following describes a structure and operations of the fixing device 19 installed in the image forming apparatus 1 depicted in FIG. 1. FIG. 2 is a sectional view of the fixing device 19. As illustrated in FIG. 2, the fixing device 19 includes a fixing roller 20, an induction heater 25, a pressing roller 30, a heater 33, an entry guide plate 41, a spur guide plate 42, a separation plate 43, an exit guide plate 50, thermistors 61 and 62, a jam detector 70, and a pressure adjuster 80.

The fixing roller 20 includes a sleeve layer 21, an insulating elastic layer 22, and a core metal 23. The induction heater 25 includes a coil 26, a core 27, and a coil guide 28. The pressing roller 30 includes an elastic layer 31 and a cylindrical member 32. The exit guide plate 50 includes a rotary shaft 50*a*.

The pressure adjuster 80 includes a lever 81, a cam 82, a feeler 83, and a photo sensor 84. The lever 81 includes a shaft 81*a*.

The induction heater 25 serves as a magnetic flux generator. The fixing roller 20 serves as a first rotary member or a fixing rotary member opposing the induction heater 25. The pressing roller 30 serves as a second rotary member or a pressing rotary member pressing against the fixing roller 20. The separation plate 43 serves as a separation member.

The fixing roller 20 has an outer diameter of about 40 mm, and includes the core metal 23 including iron and/or stainless steel, the insulating elastic layer 22 including silicon rubber foam, and the sleeve layer 21. The insulating elastic layer 22 is provided on the core metal 23. The sleeve layer 21 is provided on the insulating elastic layer 22.

The sleeve layer 21 has a multi-layer structure including a base layer, a first antioxidant layer, a heat-generating layer, a second antioxidant layer, an elastic layer, and a releasing layer. The base layer serves as an inner circumferential layer. The first antioxidant layer is provided on the base layer. The heat-generating layer is provided on the first antioxidant layer. The second antioxidant layer is provided on the heat-generating layer. The elastic layer is provided on the second antioxidant layer. The releasing layer is provided on the elastic layer. For example, the base layer has a layer thickness of about 40 μm and includes stainless steel. Each of the first antioxidant layer and the second antioxidant layer is strike-plated with nickel to have a layer thickness not greater than about 1 μm. The heat-generating layer has a layer thickness of about 10 μm and includes copper. The elastic layer has a layer thickness of about 150 μm and includes silicon rubber. The releasing layer has a layer thickness of about 30 μm and includes tetrafluoroethylene perfluoroalkylvinylether copolymer (PFA).

A magnetic flux generated by the induction heater 25 heats the heat-generating layer of the sleeve layer 21 by induction heating. The structure of the fixing roller 20 is not limited to the above-described structure. For example, the sleeve layer 21 may be separated from the insulating elastic layer 22 serving as a supplemental fixing roller and may not contact the insulating elastic layer 22. However, when the sleeve layer 21 serving as a fixing sleeve is provided separately from the insulating elastic layer 22, a movement restriction member may be provided to restrict movement of the sleeve layer 21 in a width direction, that is, in a thrust direction or an axial direction, of the fixing roller 20 when the fixing roller 20 is in operation.

The spur guide plate 42 is provided at a position facing the fixing roller 20 and upstream from a nip N formed between the fixing roller 20 and the pressing roller 30 in a recording medium conveyance direction. The spur guide plate 42 includes a plurality of spurs arranged in the width direction of the fixing roller 20. The spur guide plate 42 is provided at a position facing a fixing side, that is, a side bearing an unfixed toner image T, of a recording medium P sent toward the nip N to guide the recording medium P to the nip N. The plurality of spurs of the spur guide plate 42 includes a saw-toothed circumferential surface which does not generate scratches on the unfixed toner image T even when the plurality of spurs contacts the unfixed toner image T on the recording medium P.

The separation plate 43 is provided at a position facing the fixing roller 20 and downstream from the nip N in the recording medium conveyance direction in such a manner that the separation plate 43 faces the fixing side of the recording medium P sent out of the nip N. The separation plate 43 prevents the recording medium P sent out of the nip N after the fixing process from being attracted to the fixing roller 20 and wound around the fixing roller 20. In other words, when the recording medium P is adhered to the fixing roller 20 after the fixing process, the separation plate 43 contacts a leading edge of the recording medium P to separate the recording medium P from the fixing roller 20.

The thermistor 62 is provided near the nip N at a position upstream from the nip N in the recording medium conveyance direction, and serves as a contact temperature detection sensor which contacts the fixing roller 20. The thermistor 62 is provided at one end of the fixing roller 20 in the width direction of the fixing roller 20 to detect the surface temperature of the one end of the fixing roller 20. A thermopile serving as a non-contact temperature detection sensor is provided at a position facing a center portion of the fixing roller 20 in the width direction of the fixing roller 20. The thermopile and the thermistor 62 detect the temperature, that is, the fixing temperature, of the fixing roller 20. The controller C depicted in FIG. 1 adjusts the heating amount of the induction heater 25 based on a detection result provided by the thermopile and the thermistor 62. According to this example embodiment, the controller C controls the induction heater 25 to adjust the fixing temperature in a range from about 160 degrees centigrade to about 165 degrees centigrade during the fixing process when the recording medium P passes through the fixing device 19.

The pressing roller 30 includes the cylindrical member 32 including steel and/or aluminum, the elastic layer 31 including silicon rubber, and a releasing layer including PFA. The elastic layer 31 is provided on the cylindrical member 32. The releasing layer is provided on the elastic layer 31. The elastic layer 31 has a layer thickness in a range from about 1 mm to about 5 mm. The releasing layer has a layer thickness in a range from about 20 μm to about 200 μm. The pressing roller 30 presses against the fixing roller 20 at the nip N through which the recording medium P passes.

The heater 33 such as a halogen heater is provided inside the pressing roller 30 to increase heating efficiency for heating the fixing roller 20. When power is supplied to the heater 33, the heater 33 generates radiation heat to heat the pressing roller 30. The heated pressing roller 30 heats a surface of the fixing roller 20.

The thermistor 61 is provided near the nip N at a position upstream from the nip N in the recording medium conveyance direction, and serves as a contact temperature detection sensor for detecting the temperature of the pressing roller 30 by contacting the pressing roller 30. For example, the thermistor 61 is provided at one end of the pressing roller 30 in a width direction, that is, in an axial direction, of the pressing roller 30 to detect the surface temperature of the one end of the pressing roller 30. A thermopile serving as a non-contact temperature detection sensor faces a center portion of the pressing roller 30 in the width direction of the pressing roller 30. The thermopile and the thermistor 61 detect the temperature of the pressing roller 30, and the controller C depicted in FIG. 1 adjusts the heating amount of the heater 33 based on a detection result provided by the thermopile and the thermistor 61.

The entry guide plate 41 is provided upstream from the nip N in the recording medium conveyance direction, and faces the pressing roller 30 in such a manner that the entry guide plate 41 faces a non-fixing side of the recording medium P not bearing the unfixed toner image T, which is conveyed toward the nip N. The entry guide plate 41 guides the recording medium P to the nip N. The exit guide plate 50 is provided downstream from the nip N in the recording medium conveyance direction, and faces the pressing roller 30 in such a manner that the exit guide plate 50 faces the non-fixing side of the recording medium P sent out of the nip N. The exit guide plate 50 guides the recording medium P sent out of the nip N after the fixing process to a conveyance path provided downstream from the fixing device 19 in the recording medium conveyance direction.

Figure 3:
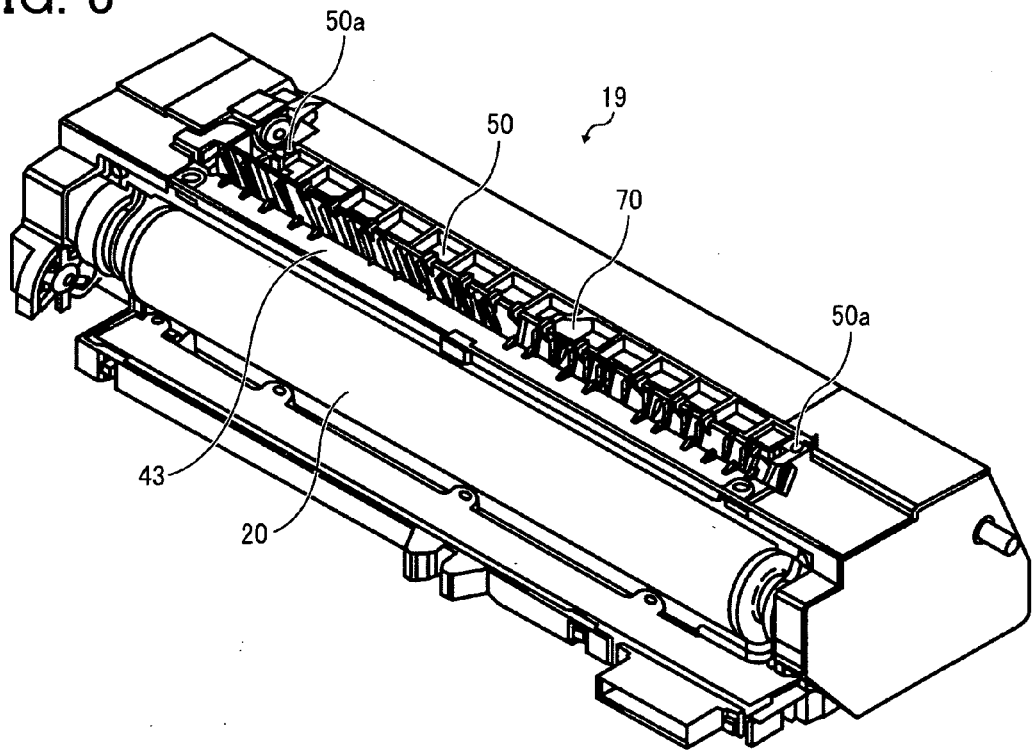
FIG. 3 is a perspective view (according to an example embodiment) of the fixing device shown in FIG. 2.

FIG. 3 is a perspective view of the fixing device 19. As illustrated in FIG. 3, the fixing device 19 further includes a grip 70.

The grip 70 is attached to the exit guide plate 50. When the recording medium P conveyed through the fixing device 19 is jammed, a user or a service engineer removes the fixing device 19 (e.g., a main body of the fixing device 19 depicted in FIG. 3) from the image forming apparatus 1 depicted in FIG. 1, and rotates the exit guide plate 50 about the rotary shaft 50*a* in a direction R1 depicted in FIG. 2 by gripping the grip 70. Accordingly, the nip N is exposed to the user or the service engineer, thus enabling the user or the service engineer to pull out and remove the jammed recording medium P from the nip N.

As illustrated in FIG. 2, the induction heater 25 includes the coil 26 serving as an exciting coil, the core 27 serving as an exciting coil core, and the coil guide 28. The coil guide 28 covers a part of the outer circumferential surface of the fixing roller 20. The coil 26 includes a litz wire formed of bundled thin wires which is wound on the coil guide 28, and extends in the width direction of the fixing roller 20, that is, in the axial direction of the fixing roller 20.

The coil guide 28 includes a heat-resistant resin material such as polyethylene terephthalate (PET) in which a glass material occupies about 45 percent. The coil guide 28 faces the outer circumferential surface of the fixing roller 20 and supports the coil 26. According to this example embodiment, a gap of 2.0±0.1 mm is provided between an opposing surface of the coil guide 28 of the induction heater 25, which opposes the fixing roller 20, and the outer circumferential surface of the fixing roller 20.

The core 27 includes a ferromagnet such as ferrite having a relative magnetic permeability of about 2,500 to generate a magnetic flux effectively toward the heat-generating layer of the fixing roller 20. The core 27 includes an arc core, a center core, and a side core.

Referring to FIG. 2, the following describes operations of the fixing device 19 having the above-described structure.

A motor rotates the fixing roller 20 counterclockwise in FIG. 2. The rotating fixing roller 20 rotates the pressing roller 30 clockwise in FIG. 2. A magnetic flux generated by the induction heater 25 heats the heat-generating layer of the sleeve layer 21 of the fixing roller 20 at an opposing position at which the heat-generating layer opposes the induction heater 25.

Specifically, an oscillator circuit of a frequency-changeable power source generates a high-frequency alternating current in a range from about 10 kHz to about 1 MHz, preferably in a range from about 20 kHz to about 800 kHz. When the high-frequency alternating current reaches the coil 26, the coil 26 generates magnetic lines of force in such a manner that the magnetic lines of force switch back and forth between the coil 26 and the sleeve layer 21 of the fixing roller 20, generating an alternating magnetic field. The alternating magnetic field generates an eddy current in the heat-generating layer of the sleeve layer 21. Electric resistance of the heat-generating layer generates Joule heat to heat the sleeve layer 21 by induction heating. Thus, the sleeve layer 21 of the fixing roller 20 is heated by induction heating performed by the heat-generating layer thereof.

When the surface of the fixing roller 20 heated by the induction heater 25 reaches the nip N at which the fixing roller 20 contacts the pressing roller 30, the fixing roller 20 heats and melts toner of a toner image T on a recording medium P passing through the nip N.

Specifically, the recording medium P bearing the toner image T formed in the above-described image forming processes is conveyed in a direction Y1 toward the nip N formed between the fixing roller 20 and the pressing roller 30 while the recording medium P is guided by the entry guide plate 41 or the spur guide plate 42. The fixing roller 20 and the pressing roller 30 apply heat and pressure to the recording medium P to fix the toner image T on the recording medium P. The recording medium P bearing the fixed toner image T is sent out of the nip N and is conveyed in a direction Y2. Thereafter, the surface of the fixing roller 20, which has passed through the nip N, reaches the opposing position at which the fixing roller 20 opposes the induction heater 25 again. The above-described series of operations is repeated continuously to finish the fixing process of the image forming processes.

Figure 4:
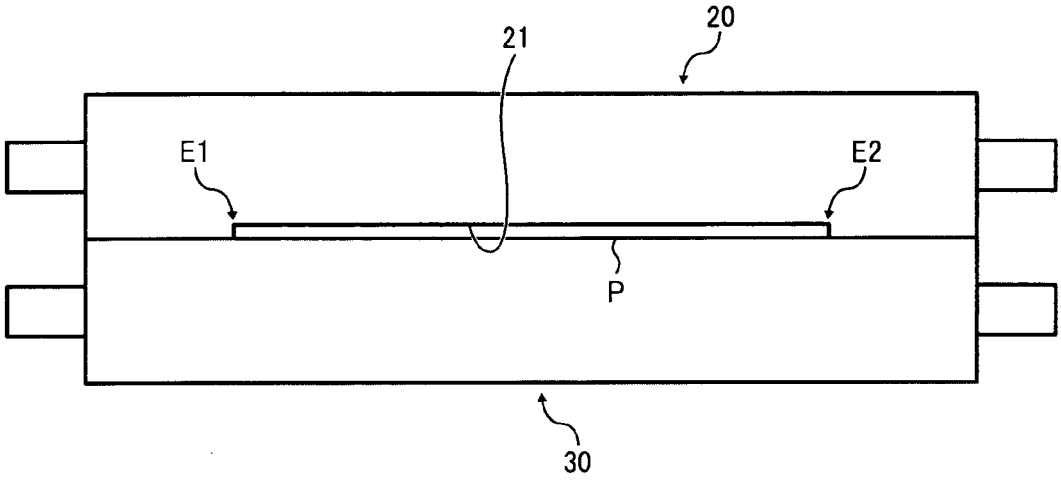
FIG. 4 is a schematic diagram (according to an example embodiment) of a fixing roller and a pressing roller included in the fixing device shown in FIG. 2 in an axial direction of the fixing roller and the pressing roller.

FIG. 4 is a schematic diagram of the fixing roller 20 and the pressing roller 30 in the axial direction of the fixing roller 20 and the pressing roller 30. In the fixing device 19 using the above-described induction heating method, when the sleeve layer 21 serving as a surface layer of the fixing roller 20 includes SUS, Ni, Pl, or the like, the sleeve layer 21 provides decreased durability and strength. Accordingly, when the recording medium P passes between the fixing roller 20 and the pressing roller 30 as illustrated in FIG. 4, the sleeve layer 21 is deformed or bent at both ends E1 and E2 of the recording medium P in a width direction of the recording medium P corresponding to the axial direction of the fixing roller 20 and the pressing roller 30. For example, when thick paper passes between the fixing roller 20 and the pressing roller 30, the sleeve layer 21 is deformed substantially, and therefore deformation marks may remain on the sleeve layer 21. Accordingly, the deformation marks may disturb proper fixing. To address this problem, according to this example embodiment, pressure applied at the nip N formed between the fixing roller 20 and the pressing roller 30 is changed according to the thickness of the recording medium P to suppress deformation of the sleeve layer 21.

The pressure adjuster 80 depicted in FIG. 2 moves the pressing roller 30 toward and away from the fixing roller 20 to change pressure applied at the nip N. As illustrated in FIG. 2, the pressure adjuster 80 includes the lever 81, the cam 82, the feeler 83, and the photo sensor 84. The lever 81 rotates about the shaft 81*a* provided at one end of the lever 81. The cam 82 contacts and presses against another end of the lever 81. The lever 81 presses against a shaft of the pressing roller 30 at a side of the lever 81 facing the pressing roller 30, which is disposed opposite a side of the lever 81 contacting the cam 82. The cam 82 has various diameters and rotates in a predetermined direction. Accordingly, as the cam 82 rotates, pressure applied by the cam 82 to the lever 81 varies to change pressure applied by the pressing roller 30 to the fixing roller 20 at the nip N. Specifically, a driver rotates the cam 82 to move the lever 81 in a horizontal direction to change pressure applied by the pressing roller 30 to the fixing roller 20 at the nip N.

The feeler 83 is mounted on a shaft supporting the cam 82 to rotate in accordance with rotation of the cam 82. The feeler 83 may be a disc including a cut portion formed by cutting away a part of the disc. The photo sensor 84 sandwiches the feeler 83 to detect whether or not the feeler 83 blocks light emitted by a light emitter toward a light receiver of the photo sensor 84. When the cut portion of the feeler 83 does not coincide with the photo sensor 84, the light receiver does not receive the light emitted by the light emitter of the photo sensor 84, and therefore the photo sensor 84 detects a light block state. By contrast, when the cut portion of the feeler 83 coincides with the photo sensor 84, the light receiver receives the light emitted by the light emitter of the photo sensor 84, and therefore the photo sensor 84 detects a light non-block state. The photo sensor 84 counts pulses generated by a stepping motor when the photo sensor 84 detects the light block state switched from the light non-block state or the light non-block state switched from the light block state, so as to detect the position of the cam 82.

Figure 5:
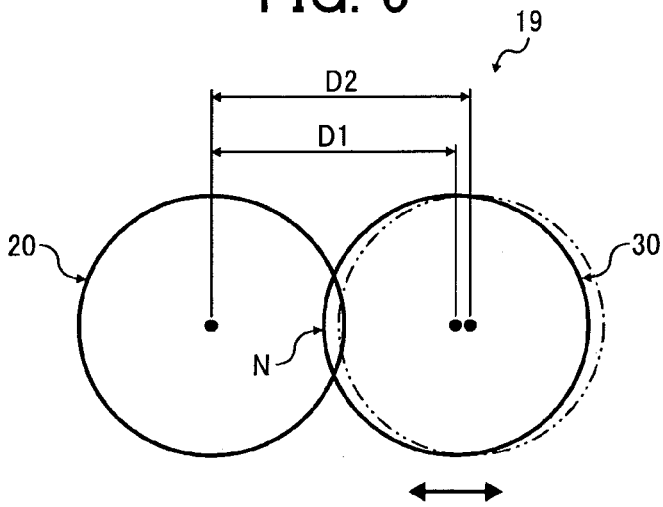
FIG. 5 is a sectional view (according to an example embodiment) of the fixing roller and the pressing roller shown in FIG. 4.

FIG. 5 is a sectional view of the fixing roller 20 and the pressing roller 30. As illustrated in FIG. 5, when thick paper, which may deform the sleeve layer 21 depicted in FIG. 4 substantially, passes between the fixing roller 20 and the pressing roller 30, the pressure adjuster 80 depicted in FIG. 2 moves the pressing roller 30 away from the fixing roller 20 while the pressing roller 30 contacts the fixing roller 20 to change a distance between a center of the fixing roller 20 and a center of the pressing roller 30 from a distance D1 to a distance D2 greater than the distance D1. Accordingly, pressure applied at the nip N is decreased and deformation of the sleeve layer 21 is suppressed. By contrast, when thin paper or plain paper, which may not deform the sleeve layer 21 substantially, passes between the fixing roller 20 and the pressing roller 30, the pressure adjuster 80 changes the distance between the center of the fixing roller 20 and the center of the pressing roller 30 from the distance D2 to the distance D1. Thus, the fixing process is performed with pressure corresponding to the thin paper or the plain paper.

The controller C depicted in FIG. 1 judges the type (e.g., thickness) of the recording medium P to be sent to the fixing device 19 based on a signal input by the recording medium type detector CP, e.g., a control panel, a button, or a menu provided on the image forming apparatus 1 depicted in FIG. 1 with which the user specifies the type of the recording medium P. The controller C controls movement of the pressure adjuster 80 to change pressure applied at the nip N according to the type of the recording medium P. Alternatively, the user may send information for specifying the type of the recording medium P to the recording medium type detector CP of the image forming apparatus 1 via a printer driver installed in a client computer, for example. Yet alternatively, a sensor provided near the feed roller 8 depicted in FIG. 1 may detect the thickness of the recording medium P, and send a detection result to the recording medium type detector CP.

The pressure applied at the nip N or the distance between the center of the fixing roller 20 and the center of the pressing roller 30 corresponding to the type or thickness of the recording medium P may be determined in advance by experiments and simulations. Further, according to this example embodiment, the pressure adjuster 80 moves the pressing roller 30 to change the pressure applied at the nip N. Alternatively, the pressure adjuster 80 may move the fixing roller 20 or may move both the pressing roller 30 and the fixing roller 20.

Figure 6:
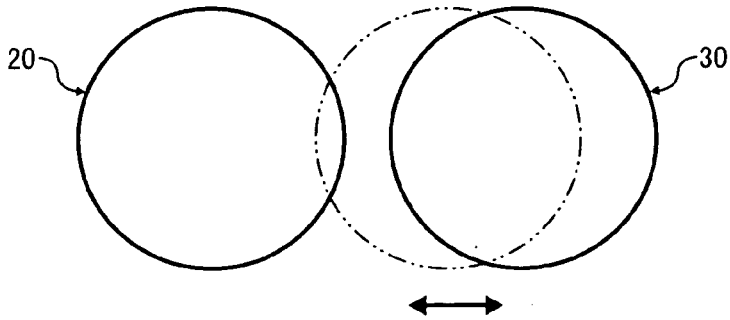
FIG. 6 is a sectional view' (according to an example embodiment) of the fixing roller and the pressing roller shown in FIG. 4.

FIG. 6 is a sectional view of the fixing roller 20 and the pressing roller 30. In the fixing device 19 depicted in FIG. 2, the fixing roller 20 and pressing roller 30 contact and separate from each other to switch between a contact state in which the pressing roller 30 contacts the fixing roller 20 to form the nip N and a non-contact state in which the pressing roller 30 separates from the fixing roller 20. In other words, the position of the fixing roller 20 and the pressing roller 30 is switchable between a contact position at which the pressing roller 30 contacts the fixing roller 20 and a non-contact position at which the pressing roller 30 does not contact the fixing roller 20. In FIG. 6, the pressing roller 30 moves toward and away from the fixing roller 20. Alternatively, the fixing roller 20 may move toward and away from the pressing roller 30. Yet alternatively, both the pressing roller 30 and the fixing roller 20 may move toward and away from each other. When the pressing roller 30 and fixing roller 20 separate from each other in the non-contact state, the user can easily remove the recording medium P jammed between the fixing roller 20 and the pressing roller 30.

The fixing device 19 includes the jam detector 70 depicted in FIG. 2. The jam detector 70 (e.g., a photo sensor) is provided downstream from the separation plate 43 in the recording medium conveyance direction, and detects that the recording medium P is jammed at the nip N. The controller C depicted in FIG. 1 separates the pressing roller 30 from the fixing roller 20 based on a detection signal provided by the jam detector 70.

Figure 7:
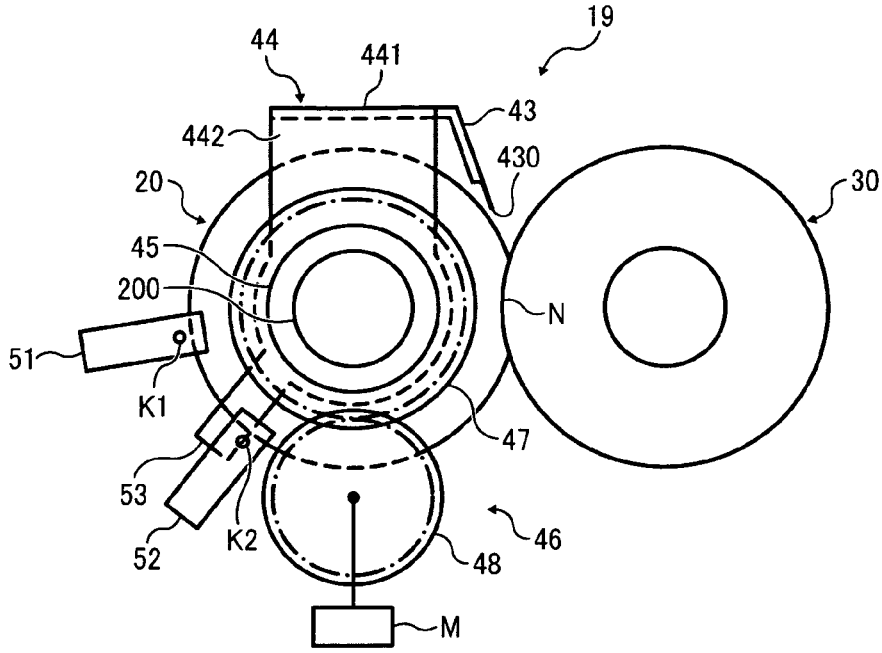
FIG. 7 is a side view (according to an example embodiment) of the fixing device shown in FIG. 2.
Figure 8:
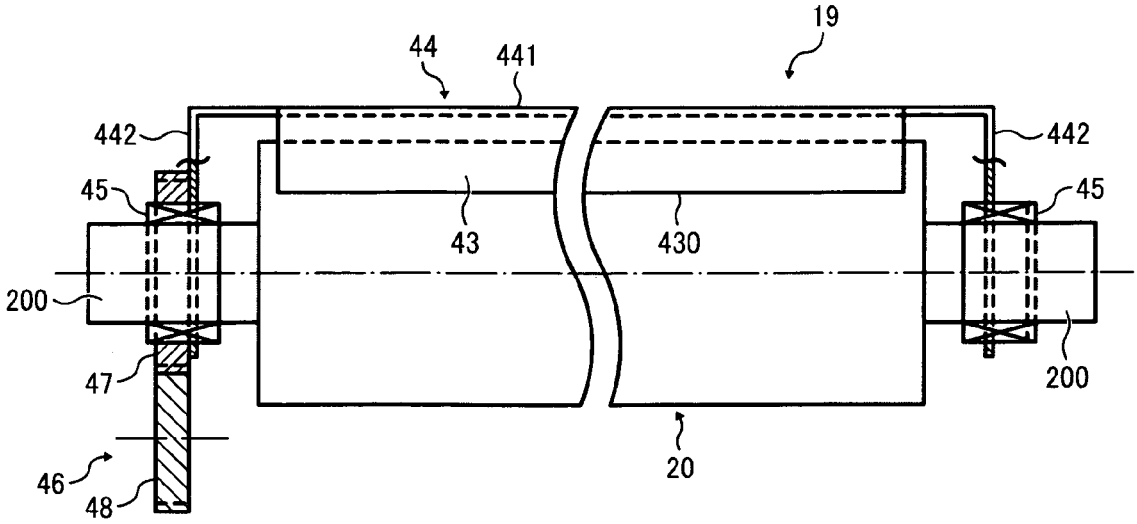
FIG. 8 is a front view (according to an example embodiment) of the fixing device shown in FIG. 7.

Referring to FIGS. 7 and 8, the following describes the fixing device 19 in detail.

FIG. 7 is a side view of the fixing device 19. As illustrated in FIG. 7, the fixing device 19 further includes a rotation support 44, bearings 45, a rotation angle adjuster 46, a first sensor 51, a second sensor 52, and a light shield 53.

The rotation support 44 includes a support 441 and a pair of arms 442. The separation plate 43 includes a front edge extension 430. The rotation angle adjuster 46 includes a rotation gear 47, a transmission gear 48, and a driver M. The first sensor 51 includes a detecting portion K1. The second sensor 52 includes a detecting portion K2. The fixing roller 20 includes a rotary shaft 200.

FIG. 8 is a front view of the fixing device 19 when the fixing roller 20 and the separation plate 43 are seen from the pressing roller 30 depicted in FIG. 7.

As illustrated in FIGS. 7 and 8, the rotation support 44 is mounted on the rotary shaft 200 of the fixing roller 20, and supports the separation plate 43. The rotation support 44 includes the support 441 for supporting the separation plate 43, and the pair of arms 442 provided at both ends of the support 441 in a longitudinal direction of the support 441 corresponding to the axial direction of the fixing roller 20. Each of the arms 442 is rotatively connected to the rotary shaft 200 of the fixing roller 20 via the bearing 45. Thus, the separation plate 43 rotates about the rotary shaft 200 of the fixing roller 20. The rotation support 44 supports the separation plate 43 in such a manner that the front edge extension 430 of the separation plate 43 does not contact the outer circumferential surface of the fixing roller 20, that is, maintains a predetermined gap provided between the front edge extension 430 and the fixing roller 20.

The rotation angle adjuster 46 moves the separation plate 43 in a circumferential direction of the fixing roller 20 to change a rotation angle, (e.g., a rotation angle position) of the separation plate 43. The rotation angle adjuster 46 includes the rotation gear 47, the transmission gear 48, and the driver M. The rotation gear 47 engages one of the bearings 45 mounted on the rotary shaft 200 of the fixing roller 20. According to this example embodiment, the rotation gear 47 engages the left bearing 45 in FIG. 8. The rotation gear 47 is fixed to the rotation support 44. Accordingly, the rotation gear 47, the rotation support 44, and the separation plate 43 rotate about the rotary shaft 200 of the fixing roller 20 together. The transmission gear 48 engages the rotation gear 47. A driving force generated by the driver M is transmitted to the rotation gear 47 via the transmission gear 48.

According to this example embodiment, a stepping motor is used as the driver M. The stepping motor rotates forward and backward by a predetermined angle according to the number of pulses of driving pulse signals entering the stepping motor. Accordingly, driving of the stepping motor is controlled to stop the separation plate 43 at an arbitrary position (e.g., an arbitrary rotation angle position) precisely.

Changing the rotation angle position of the separation plate 43 is controlled by a rotation detector for detecting the rotation angle position of the separation plate 43 and the controller C depicted in FIG. 1 for controlling driving of the stepping motor according to a detection signal generated by the rotation detector.

For example, as illustrated in FIG. 7, the first sensor 51 and the second sensor 52 serve as the rotation detector. The first sensor 51 detects a home position (e.g., a reference position) of the separation plate 43. The second sensor 52 detects the rotation angle positions other than the home position, which correspond to various purposes. Each of the first sensor 51 and the second sensor 52 includes a transmission optical sensor in which a light emitter for emitting light is disposed opposite a light receiver for receiving the light emitted by the light emitter. The detecting portion K1 of the first sensor 51 includes the light emitter and the light receiver. The detecting portion K2 of the second sensor 52 includes the light emitter and the light receiver.

The light shield 53 (e.g., a shield plate) having a convex shape is mounted on the arm 442 of the rotation support 44, and serves as a detected portion detected by the first sensor 51 and the second sensor 52. The light shield 53 passes between the light emitter and the light receiver of the first sensor 51, that is, the detecting portion K1 of the first sensor 51, in accordance with rotation of the rotation support 44. Similarly, the light shield 53 passes between the light emitter and the light receiver of the second sensor 52, that is, the detecting portion K2 of the second sensor 52, in accordance with rotation of the rotation support 44. When the light shield 53 is not between the light emitter and the light receiver, the light receiver receives light emitted by the light emitter. By contrast, when the light shield 53 is between the light emitter and the light receiver, the light shield 53 blocks the light emitted by the light emitter. Each of the first sensor 51 and the second sensor 52 detects the position of the light shield 53 by using the difference between output of the light receiver when the light receiver receives the light emitted by the light emitter and output of the light receiver when the light receiver does not receive the light emitted by the light emitter. Thus, each of the first sensor 51 and the second sensor 52 detects the rotation angle position of the separation plate 43 supported by the rotation support 44.

According to this example embodiment, the transmission optical sensor is used as the rotation detector. Alternatively, a reflection optical sensor may be used as the rotation detector. For example, a reflection plate replaces the light shield 53, and the reflection optical sensor detects reflection light reflected by the reflection plate when the reflection plate passes over the light emitter. Thus, the reflection optical sensor detects the position of the reflection plate. Yet alternatively, a magnetic sensor may be used as the rotation detector. For example, a magnetic member serving as a detected portion is mounted on the rotation support 44, and the magnetic sensor detects change of a magnetic field when the magnetic member passes over the magnetic sensor. Thus, the magnetic sensor detects the position of the detected portion.

Figure 9:
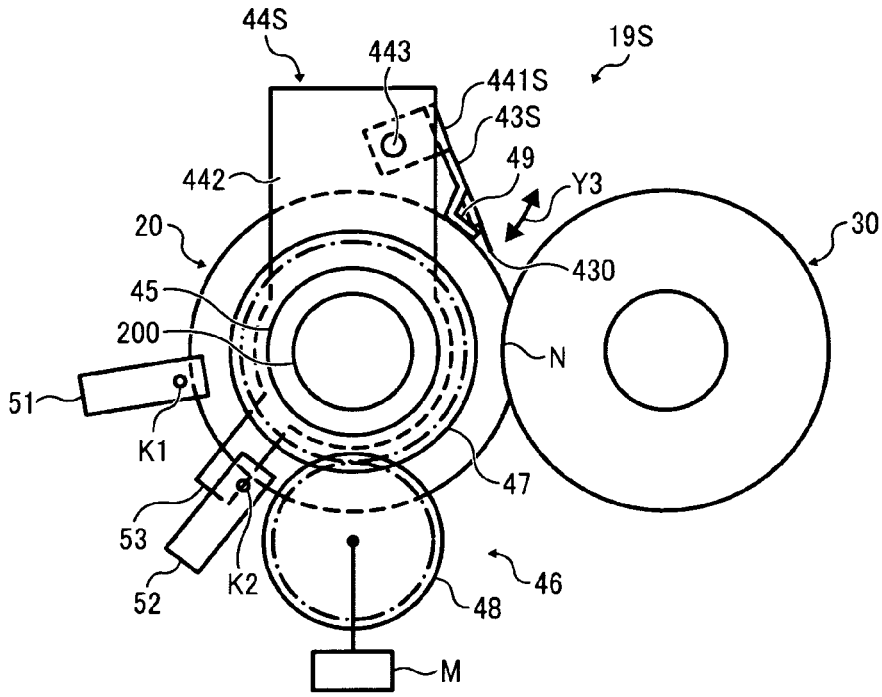
FIG. 9 is a side view of a fixing device according to another example embodiment.
Figure 10:
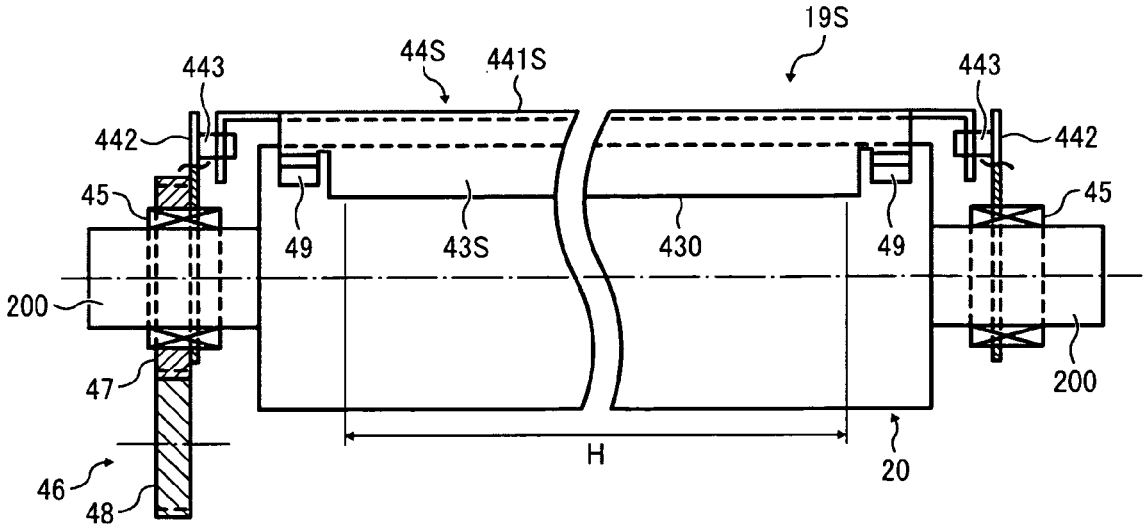
FIG. 10 is a front view (according to an example embodiment) of the fixing device shown in FIG. 9.

Referring to FIGS. 9 and 10, the following describes a fixing device 19S according to another example embodiment.

FIG. 9 is a side view of the fixing device 19S. As illustrated in FIG. 9, the fixing device 19S includes a separation plate 43S, a rotation support 44S, and contact members 49. The rotation support 44S includes a support 441S, the arms 442, and axes 443. The other elements of the fixing device 19S are equivalent to the elements of the fixing device 19 depicted in FIG. 7.

FIG. 10 is a front view of the fixing device 19S when the fixing roller 20 and the separation plate 43S are seen from the pressing roller 30 depicted in FIG. 9.

In the fixing device 19S, the separation plate 43S serving as a separation member and the rotation support 44S for supporting the separation plate 43S have a structure different from the structure of the separation plate 43 and the rotation support 44 of the fixing device 19 depicted in FIG. 7. For example, as illustrated in FIGS. 9 and 10, the rotation support 44S includes the support 441S to which the separation plate 43S is attached, and the pair of arms 442 rotatively mounted on the rotary shaft 200 of the fixing roller 20. The support 441S is rotatively mounted on the axis 443 provided on each of the arms 442. When the support 441S rotates about the axes 443, the separation plate 43S swings in a direction Y3. Accordingly, the front edge extension 430 of the separation plate 43S moves closer to and away from the outer circumferential surface of the fixing roller 20.

The contact members 49 are provided at both ends of the separation plate 43S, respectively, in the axial direction of the fixing roller 20, and contact the outer circumferential surface of the fixing roller 20. When the contact members 49 contact the fixing roller 20, the front edge extension 430 of the separation plate 43S does not contact the fixing roller 20 and maintains a predetermined gap provided between the front edge extension 430 and the outer circumferential surface of the fixing roller 20. The weight of the separation plate 43S biases the separation plate 43S downward toward the fixing roller 20 to cause the contact members 49 to contact the outer circumferential surface of the fixing roller 20 constantly. Alternatively, a biasing member such as a spring may bias the separation plate 43S toward the fixing roller 20 to cause the contact members 49 to contact the outer circumferential surface of the fixing, roller 20 constantly.

The pair of contact members 49 is provided outboard of a recording medium passage width H depicted in FIG. 10.

Accordingly, the contact members 49 do not contact the fixing roller 20 within the recording medium passage width H. Consequently, the contact members 49 do not wear or damage the outer circumferential surface of the fixing roller 20 in the recording medium passage width H, resulting in proper fixing. When the fixing device 19S accommodates recording media of various sizes, the width of the maximum size recording medium is used as the recording medium passage width H, that is, the maximum recording medium passage width.

The structure of the fixing device 19S other than the structure described above by referring to FIGS. 9 and 10 is equivalent to the structure of the fixing device 19 depicted in FIGS. 7 and 8, and therefore detailed descriptions are omitted. In other words, in the fixing device 19S also, the separation plate 43A is rotatable about the rotary shaft 200 of the fixing roller 20 to change the rotation angle position of the separation plate 43S.

Figure 11:
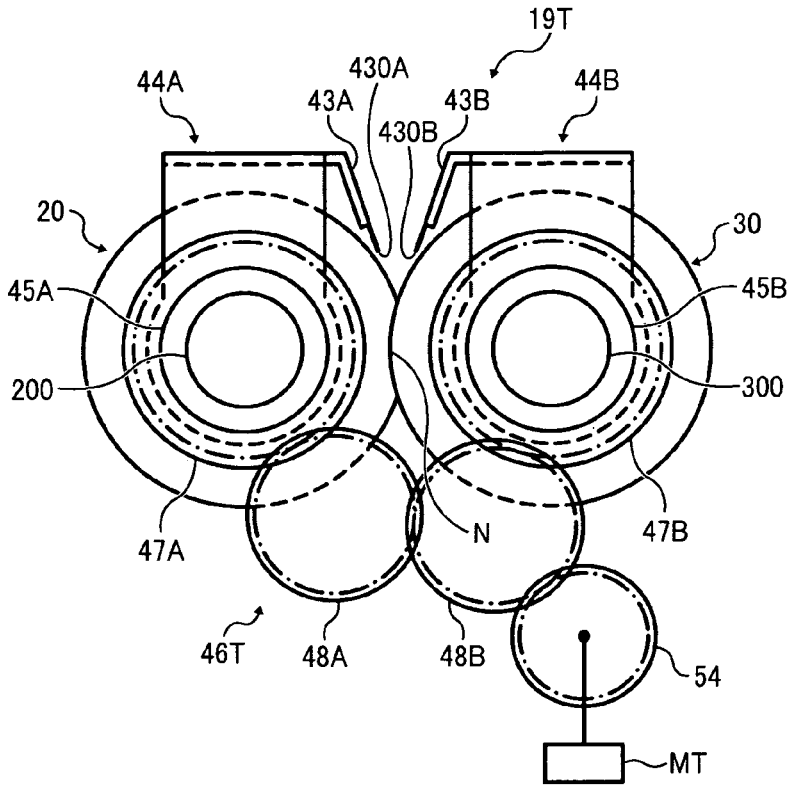
FIG. 11 is a side view of a fixing device according to yet another example embodiment.
Figure 12:
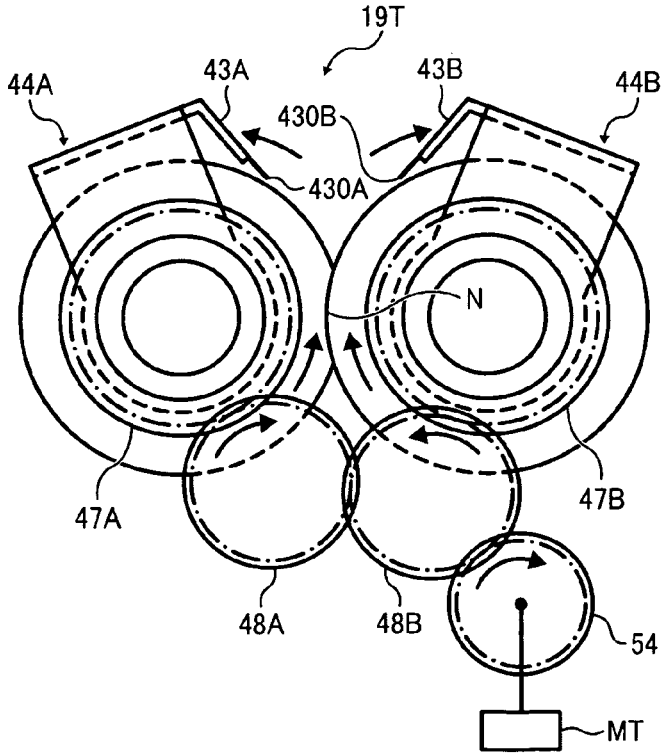
FIG. 12 is a side view (according to an example embodiment) of the fixing device shown in FIG. 11 for explaining operations for moving separation plates included in the fixing device.
Figure 13:
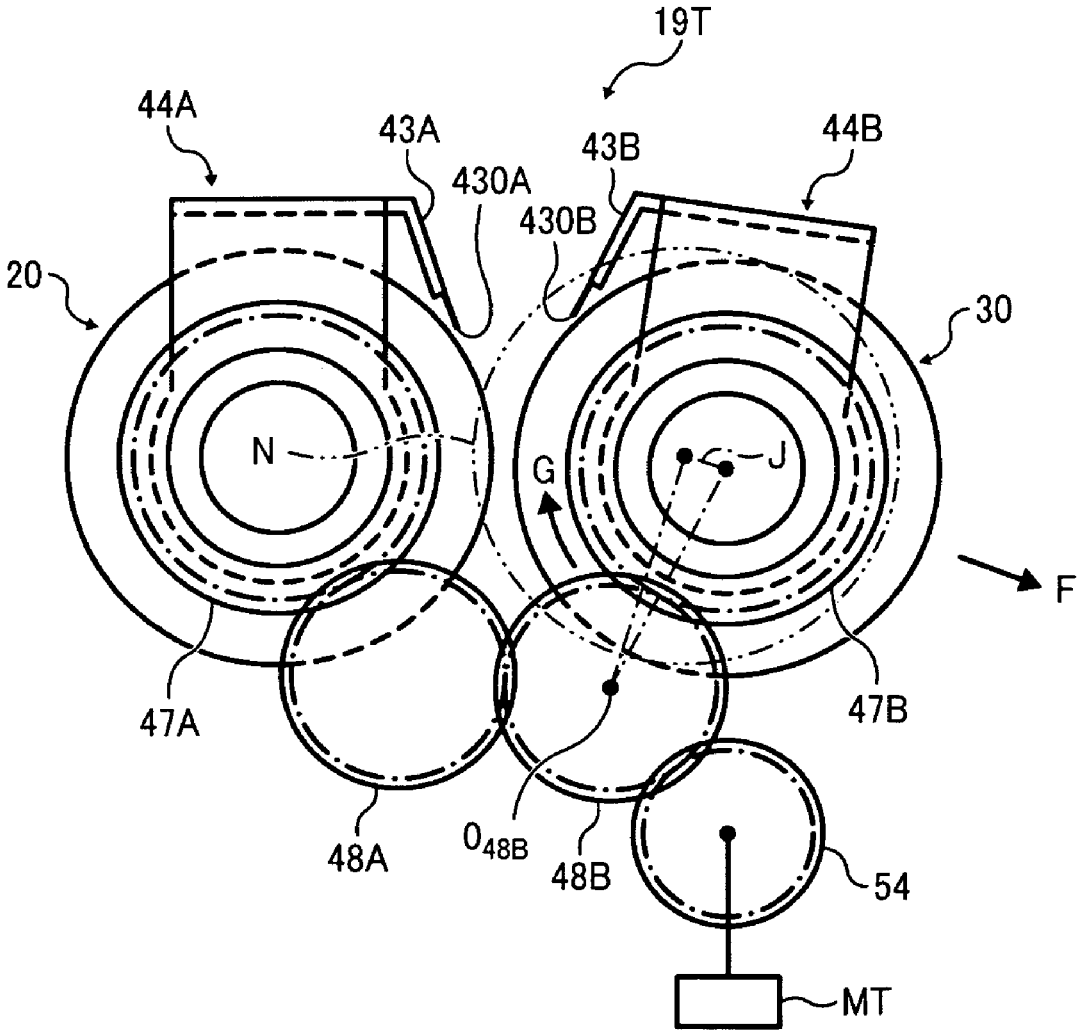
FIG. 13 is a side view (according to an example embodiment) of the fixing device shown in FIG. 11 for explaining operations for moving a pressing roller with respect to a fixing roller included in the fixing device.

Referring to FIGS. 11 to 13, the following describes a fixing device 19T according to yet another example embodiment.

FIG. 11 is a side view of the fixing device 19T. As illustrated in FIG. 11, the fixing device 19T includes the fixing roller 20, the pressing roller 30, separation plates 43A and 43B, rotation supports 44A and 44B, bearings 45A and 45B, and a rotation angle adjuster 46T. The fixing roller 20 includes the. rotary shaft 200. The pressing roller 30 includes a rotary shaft 300. The separation plate 43A includes a front edge extension 430A. The separation plate 43B includes a front edge extension 430B. The rotation angle adjuster 46T includes rotation gears 47A and 47B, transmission gears 48A and 48B, an input gear 54, and a driver. MT.

FIG. 12 is a side view of the fixing device 19T for explaining operations for moving the separation plates 43A and 43B away from the nip N.

FIG. 13 is a side view of the fixing device 19T for explaining operations for moving the pressing roller 30 with respect to the fixing roller 20.

In the fixing device 19T, the separation plates 43A and 43B, serving as separation members, are provided on the fixing roller 20 and the pressing roller 30, respectively. The separation plate 43A separates a recording medium from the fixing roller 20 and the separation plate 43B separates the recording medium from the pressing roller 30. When the image forming apparatus 1 depicted in FIG. 1 provides duplex printing, a toner image formed on the front side of the recording medium contacts the fixing roller 20 and a toner image formed on the back side of the recording medium contacts the pressing roller 30 when the recording medium passes through the fixing device 19T for fixing. The separation plates 43A and 43B effectively prevent the recording medium from being wound around the fixing roller 20 and the pressing roller 30, respectively.

The rotation supports 44A and 44B support the separation plates 43A and 43B, respectively. In the fixing device 19T, like in the fixing device 19 depicted in FIG. 7, the separation plates 43A and 43B are fixed to the rotation supports 44A and 44B, respectively. Alternatively, like in the fixing device 19S depicted in FIG. 9, the separation plates 43A and 43B may swing with respect to the rotation supports 44A and 44B, respectively. The rotation supports 44A and 44B are rotatively connected to the rotary shafts 200 and 300 of the fixing roller 20 and the pressing roller 30 via the bearings 45A and 45B, respectively.

In the fixing device 19T, the rotation angle adjuster 46T changes the position (e.g., the rotation angle position) of each of the separation plates 43A and 43B, and includes the pair of rotation gears 47A and 47B, the pair of transmission gears 48A and 48B, the single input gear 54, and the driver MT. The rotation gears 47A and 47B are fixed to the rotation supports 44A and 44B and engage the bearings 45A and 45B, respectively. Accordingly, when the rotation gears 47A and 47B rotate, the rotation supports 44A and 44B and the separation plates 43A and 43B rotate about the rotary shafts 200 and 300 of the fixing roller 20 and the pressing roller 30 together, respectively. The transmission gear 48A engages the rotation gear 47A and the transmission gear 48B. Similarly, the transmission gear 48B engages the rotation gear 47B and the transmission gear 48A. One of the pair of transmission gears 48A and 48B, that is, the right transmission gear 48B in FIG. 11, engages the input gear 54. Accordingly, a driving force applied by the driver MT to the input gear 54 is transmitted to the rotation gears 47A and 47B via the transmission gears 48A and 48B, respectively.

For example, when the input gear 54 rotates clockwise in FIG. 12, the transmission gear 48B engaging the input gear 54 rotates counterclockwise in FIG. 12. The rotating transmission gear 48B rotates another transmission gear 48A clockwise in FIG. 12. The rotating transmission gear 48A rotates the rotation gear 47A counterclockwise in FIG. 12, and the rotating rotation gear 47A rotates the rotation support 44A counterclockwise in FIG. 12. Similarly, the rotating transmission gear 48B rotates the rotation gear 47B clockwise in FIG. 12, and the rotating rotation gear 47B rotates the rotation support 44B clockwise in FIG. 12. Accordingly, the separation plates 43A and 43B rotate in directions in which the separation plates 43A and 43B move away from the nip N, respectively. By contrast, when the input gear 54 rotates counterclockwise in FIG. 12, the transmission gears 48A and 48B and the rotation gears 47A and 47B rotate in directions opposite the directions in which the transmission gears 48A and 48B and the rotation gears 47A and 47B rotate when the input gear 54 rotates clockwise in FIG. 12. Accordingly, the separation plates 43A and 43B rotate in directions in which the separation plates 43A and 43B move closer to the nip N.

As described above, in the fixing device 19T, the driving force generated by the driver MT is transmitted to the rotation supports 44A and 44B via the transmission gears 48A and 48B and the rotation gears 47A and 47B, respectively. In other words, the driver MT is interlocked with the pair of separation plates 43A and 43B to move the separation plates 43A and 43B closer to and away from the nip N.

As illustrated in FIG. 13, in the fixing device 19T also, the pressing roller 30 moves toward the fixing roller 20 to contact the fixing roller 20 in the contact state and moves away from the fixing roller 20 to separate from the fixing roller 20 in the non-contact state. Thus, the state of the fixing roller 20 and the pressing roller 30 is switchable between the contact state and the non-contact state. In other words, the position of the fixing roller 20 and the pressing roller 30 is switchable between the contact position at which the pressing roller 30 contacts the fixing roller 20 and the non-contact position at which the pressing roller 30 does not contact the fixing roller 20.

A moving route J on which the pressing roller 30 moves toward and away from the fixing roller 20 has an arc shape formed about a center $O_{48B}$ of the transmission gear 48B engaging the rotation gear 47B provided on the pressing roller 30. The rotation gear 47B mounted on the rotary shaft 300 of the pressing roller 30 rotates together with the pressing roller 30. Accordingly, the moving route J also serves as a moving route of the rotation gear 47B. In other words, the rotation gear 47B is movable to draw an arc along a set of gears (e.g., a set of teeth) of the transmission gear 48B engaging the rotation gear 47B.

In the fixing device 19T, the pressing roller 30 moves toward and away from the fixing roller 20. Alternatively, the fixing roller 20 may move toward and away from the pressing roller 30, and a moving route on which the fixing roller 20 moves toward and away from the pressing roller 30 may have an arc shape formed about a center of the transmission gear 48A engaging the rotation gear 47A provided on the fixing roller 20. The structure of the fixing device 19T other than the structure described above by referring to FIGS. 11 to 13 is equivalent to the structure of the fixing device 19 depicted in FIGS. 7 and 8, and therefore detailed descriptions are omitted.

Figure 14A:
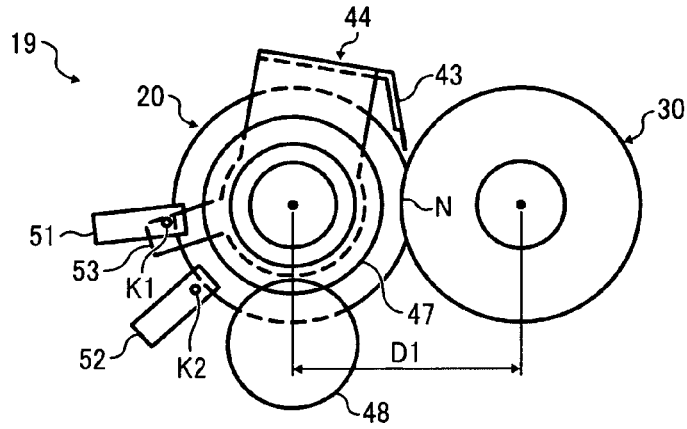
FIG. 14A is a side view (according to an example embodiment) of the fixing device shown in FIG. 7 illustrating a home position of a separation plate included in the fixing device.
Figure 14B:
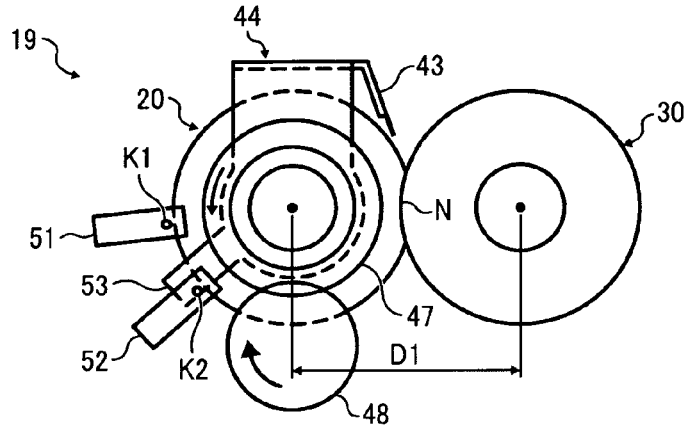
FIG. 14B is a side view (according to an example embodiment) of the fixing device shown in FIG. 7 illustrating a position of a separation plate included in the fixing device when plain paper passes through the fixing device.
Figure 14C:
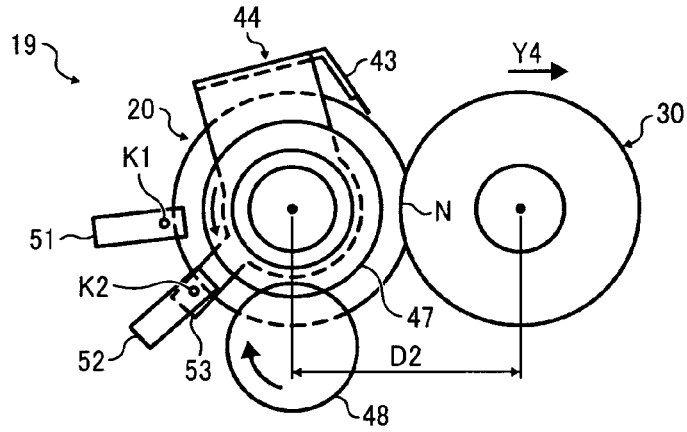
FIG. 14C is a side view (according to an example embodiment) of the fixing device shown in FIG. 7 illustrating a position of a separation plate included in the fixing device when thick paper passes through the fixing device.
Figure 14D:
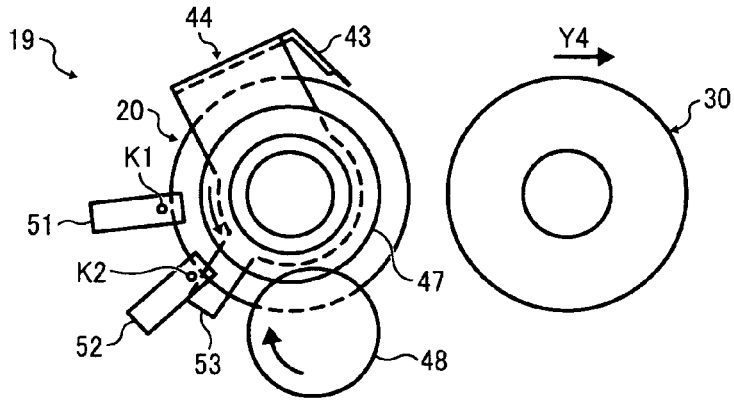
FIG. 14D is a side view (according to an example embodiment) of the fixing device shown in FIG. 7 illustrating a position of a separation plate included in the fixing device when a recording medium is jammed in the fixing device.

Referring to FIGS. 14A, 14B, 14C, and 14D, the following describes a control method for controlling the fixing device 19 depicted in FIG. 7. FIGS. 14A, 14B, 14C, and 14D illustrate the rotation angle positions of the separation plate 43 of the fixing device 19. FIG. 14A is a side view of the fixing device 19 illustrating the home position of the separation plate 43. FIG. 14B is a side view of the fixing device 19 illustrating the rotation angle position of the separation plate 43 when plain paper serving as a recording medium passes through the fixing device 19. FIG. 14C is a side view of the fixing device 19 illustrating the rotation angle position of the separation plate 43 when thick paper serving as a recording medium passes through the fixing device 19. FIG. 14D is a side view of the fixing device 19 illustrating the rotation angle position of the separation plate 43 when a recording medium is jammed in the fixing device 19.

When the image forming apparatus 1 depicted in FIG. 1 is powered on, the separation plate 43 is at the home position illustrated in FIG. 14A. The light shield 53 coincides with the detecting portion K1 of the first sensor 51, and blocks light emitted by the light emitter of the first sensor 51. By contrast, in the second sensor 52, light emitted by the light emitter irradiates the light receiver. The predetermined distance D1 is provided between the center of the fixing roller 20 and the center of the pressing roller 30, and predetermined pressure is applied at the nip N.

When plain paper serving as a recording medium passes through the fixing device 19, the rotation support 44 rotates counterclockwise to move the separation plate 43 from the home position illustrated in FIG. 14A to the rotation angle position illustrated in FIG. 14B. For example, the controller C depicted in FIG. 1 drives the driver M (e.g., the stepping motor) depicted in FIG. 7 based on a signal generated by the recording medium type detector CP depicted in FIG. 1 (e.g., the control panel, the button, or the menu) with which the user specifies the type of the recording medium. A driving force generated by the driver M is transmitted to the rotation gear 47 via the transmission gear 48 to rotate the rotation gear 47 counterclockwise in FIG. 14B together with the rotation support 44. In accordance with rotation of the rotation support 44, the light shield 53 moves toward the second sensor 52. When the light shield 53 reaches the detecting portion K2 of the second sensor 52, and the second sensor 52 detects that the light shield 53 blocks light emitted by the light emitter, the controller C stops driving the driver M to stop the light shield 53. Accordingly, the separation plate 43 is at the rotation angle position for plain paper illustrated in FIG. 14B. When the plain paper passes through the fixing device 19, the predetermined distance D1 is provided between the center of the fixing roller 20 and the center of the pressing roller 30 like in FIG. 14A. Thus, when the separation plate 43 is at the rotation angle position for plain paper illustrated in FIG. 14B, the plain paper passes through the nip N to fix a toner image on the plain paper. Thereafter, the separation plate 43 separates the plain paper from the fixing roller 20.

When thick paper serving as a recording medium passes through the fixing device 19, the pressing roller 30 moves in a direction Y4 to separate from the fixing roller 20 as illustrated in FIG. 14C. Accordingly, the distance D2, which is greater than the distance D1 for plain paper, is provided between the center of the fixing roller 20 and the center of the pressing roller 30. Consequently, when the thick paper passes through the fixing device 19, pressure, which is smaller than pressure applied when the plain paper passes through the fixing device 19, is applied at the nip N to prevent the thick paper moving over the surface of the fixing roller 20 from deforming (e.g., bending) the surface of the fixing roller 20, that is, the sleeve layer 21 depicted in FIG. 4.

When the thick paper passes through the fixing device 19, the rotation support 44 rotates counterclockwise to move the separation plate 43 from the home position illustrated in FIG. 14A to the rotation angle position illustrated in FIG. 14C. For example, the light shield 53 moves toward the second sensor 52 like when the plain paper passes through the fixing device 19. When the second sensor 52 detects that the light shield 53 reaches the detecting portion K2, the controller C depicted in FIG. 1 inputs the predetermined number of pulse signals into the driver M depicted in FIG. 7 to rotate the rotation support 44 counterclockwise by a predetermined angle, and then stops the driver M. Accordingly, the light shield 53 stops at a position provided somewhat downstream from the position for the plain paper illustrated in FIG. 14B in a counterclockwise direction, at which the light shield 53 does not pass over the detecting portion K2 completely. Thus, when the thick paper passes through the fixing device 19, the light shield 53 moves to the position provided downstream from the position for the plain paper illustrated in FIG. 14B in the counterclockwise direction. Accordingly, the separation plate 43 moves to the rotation angle position illustrated in FIG. 14C which is separated from the nip N farther than the rotation angle position for the plain paper illustrated in FIG. 14B in correspondence to the movement of the light shield 53.

When the thick paper passes through the fixing device 19, the separation plate 43 is separated from the nip N farther than when the plain paper passes through the fixing device 19 to suppress a streaked image formed when the front edge extension 430 depicted in FIG. 7 of the separation plate 43 scratches a toner image on the recording medium or a stained background formed when toner adhered from the recording medium to the separation plate 43 is adhered to the recording medium again. Generally, thick paper has a greater rigidity than plain paper, and therefore is separated from the fixing roller 20 easily. Accordingly, even when the separation plate 43 is separated from the nip N substantially, and therefore the separation plate 43 provides a decreased separation ability, thick paper passing through the fixing device 19 is separated from the fixing roller 20 properly.

The operation to change the rotation angle position of the separation plate 43 may be performed in synchronization with the operation to change pressure applied at the nip N. Alternatively, the operation to change the rotation angle position of the separation plate 43 and the operation to change pressure applied at the nip N may be performed at different times, respectively.

When the recording medium, which is either plain paper or thick paper, is jammed between the fixing roller 20 and the pressing roller 30, the pressing roller 30 is separated from the fixing roller 20 so that the pressing roller 30 does not contact the fixing roller 20 as illustrated in FIG. 14D. For example, the controller C depicted in FIG. 1 separates the pressing roller 30 from the fixing roller 20 based on a detection signal provided by the jam detector 70 depicted in FIG. 2 when the jam detector 70 detects that the recording medium is jammed. When the pressing roller 30 separates from the fixing roller 20 and therefore does not contact the fixing roller 20, the user can remove the jammed recording medium easily.

When the jam detector 70 detects that the recording medium is jammed, the rotation support 44 rotates counterclockwise to move the separation plate 43 from the position for plain paper illustrated in FIG. 14B or the position for thick paper illustrated in FIG. 14C to the position illustrated in FIG. 14D. Specifically, the controller C drives the driver M depicted in FIG. 7 based on a detection signal provided by the jam detector 70 to rotate the rotation support 44 counterclockwise. When the light shield 53 has passed through the detecting portion K2 of the second sensor 52, and therefore the second sensor 52 detects that the light receiver of the second sensor 52 receives light emitted by the light emitter of the second sensor 52, the controller C stops driving the driver M to stop the light shield 53. Accordingly, the separation plate 43 reaches the retract position, that is, the rotation angle position illustrated in FIG. 14D, which is provided away from the nip N formed between the fixing roller 20 and the pressing. roller 30 farther than the position for plain paper illustrated in FIG. 14B or the position for thick paper illustrated in FIG. 14C. Thus, when the recording medium is jammed, the separation plate 43 retracts from the nip N to facilitate removal of the recording medium by the user.

The operation to change the rotation angle position of the separation plate 43 may be performed in synchronization with the operation to separate the pressing roller 30 from the fixing roller 20. Alternatively, the operation to change the rotation angle position of the separation plate 43 and the operation to separate the pressing roller 30 from the fixing roller 20 may be performed at different times, respectively.

When removal of the jammed recording medium is finished, the separation plate 43 returns to the home position illustrated in FIG. 14A. Before the separation plate 43 moves from the position for plain paper illustrated in FIG. 14B to the position for thick paper illustrated in FIG. 14C, and vice versa, the separation plate 43 returns to the home position illustrated in FIG. 14A, and then moves to the position for plain paper illustrated in FIG. 14B or the position for thick paper illustrated in FIG. 14C. In order to move the separation plate 43 from the position illustrated in FIG. 14B, 14C, or 14D to the home position illustrated in FIG. 14A, the controller C drives the driver M to rotate the rotation support 44 clockwise. When the light shield 53 reaches the detecting portion K1 of the first sensor 51, and therefore the first sensor 51 detects that the light shield 53 blocks light emitted by the light emitter of the first sensor 51, the controller C stops driving the driver M to stop the light shield 53. Thus, the separation plate 43 is at the home position illustrated in FIG. 14A. When the separation plate 43 returns to the home position illustrated in FIG. 14A from the position illustrated in FIG. 14C or the position illustrated in FIG. 14D, the pressing roller 30 moves toward the fixing roller 20 so that the predetermined distance D1 is provided between the center of the fixing roller 20 and the center of the pressing roller 30.

The operation to move the pressing roller 30 toward the fixing roller 20 may be performed in synchronization with the operation to move the separation plate 43 to the home position illustrated in FIG. 14A. Alternatively, the operation to move the pressing roller 30 toward the fixing roller 20 and the operation to move the separation plate 43 to the home position illustrated in FIG. 14A may be performed at different times, respectively.

The above-described control method performed in the fixing device 19 may be used in the fixing device 19S depicted in FIGS. 9 and 10. In the fixing device 19S, the front edge extension 430 of the separation plate 43S moves closer to and away from the outer circumferential surface of the fixing roller 20. Even when a recording medium enters between the separation plate 43S and the fixing roller 20 and is jammed between the separation plate 43S and the fixing roller 20, the separation plate 43S swings to separate the front edge extension 430 from the fixing roller 20. Accordingly, the user can remove the jammed recording medium easily.

Referring to FIGS. 11 to 13, the following describes a control method performed in the fixing device 19T. When a recording medium is jammed in the fixing device 19T, the pressing roller 30 moves in a direction F depicted in FIG. 13 to separate from the fixing roller 20. The driver MT does not input a driving force to the input gear 54, and therefore the transmission gears 48A and 48B are stopped. Accordingly, the rotation gear 47B connected to the pressing roller 30 rotates along the set of gears (e.g., the set of teeth) of the stopped transmission gear 48B in a direction G while the rotation gear 47B moves in the direction F. The rotation support 44B rotates in the direction G in accordance with rotation of the rotation gear 47B. Accordingly, the separation plate 43B provided on the pressing roller 30 moves away from the nip N formed between the fixing roller 20 and the pressing roller 30. Consequently, the separation plate 43B retracts from the nip N to facilitate removal of the jammed recording medium by the user.

When removal of the jammed recording medium is finished, the pressing roller 30 moves toward the fixing roller 20. Accordingly, the rotation gear 47B rotates along the transmission gear 48B in a direction opposite the direction G. Consequently, the separation plate 43B moves toward the nip N, that is, an opposing portion at which the pressing roller 30 opposes the fixing roller 20, to return to the original position.

As described above, in the fixing device 19T, the separation plate 43B is retracted from and is moved toward the nip N without driving the driver MT, suppressing energy consumption and saving energy.

The moving route J on which the pressing roller 30 and the rotation gear 47B mounted on the pressing roller 30 move draws an arc shape formed about the center $O_{48B}$ of the transmission gear 48B. Accordingly, even when the pressing roller 30 moves toward and away from the fixing roller 20, the rotation gear 47B engages the transmission gear 48B constantly. In other words, the input gear 54 may start rotating at a time when the pressing roller 30 is at an arbitrary position to change the rotation angle position of the separation plates 43A and 43B. Accordingly, when the separation plate 43B does not retract from the nip N sufficiently by separating the pressing roller 30 from the fixing roller 20 only, the controller C depicted in FIG. 1 may drive the driver MT to move the separation plate 43B away from the nip N farther.

The operation to move the separation plate 43B by driving the driver MT may be performed in synchronization with the operation to move the separation plate 43B by separating the pressing roller 30 from the fixing roller 20. Alternatively, the operation to move the separation plate 43B by driving the driver MT and the operation to move the separation plate 43B by separating the pressing roller 30 from the fixing roller 20 may be performed at different times, respectively.

In the fixing device 19T also, like in the fixing devices 19 and 19S depicted in FIGS. 7 and 9, respectively, the pressing roller 30 may move with respect to the fixing roller 20 to change pressure applied at the nip N according to the type of the recording medium (e.g., plain paper or thick paper). Further, the rotation angle position of the pair of separation plates 43A and 43B may be changed to adjust a distance between each of the front edge extensions 430A and 430B of the separation plates 43A and 43B and the nip N according to the type of the recording medium.

As described above, in a fixing device (e.g., the fixing device 19, 19S, or 19T depicted in FIG. 7, 9, or 11, respectively), the rotation angle position of a separation member (e.g., the separation plate 43, 43S, or 43A and 43B depicted in FIG. 7, 9, or 11, respectively) is changed to move a front edge extension (e.g., the front edge extension 430 depicted in FIG. 7 or 9 or the front edge extensions 430A and 430B depicted in FIG. 11) of the separation member toward and away from a nip (e.g., the nip N depicted in FIG. 7, 9, or 11) to adjust the separation ability of the separation member. For example, when a thin sheet having a low rigidity and a decreased separation ability passes through the fixing device as a recording medium, the front edge extension of the separation member moves closer to the nip to improve the separation ability. By contrast, when a thick sheet having a high rigidity and an increased separation ability passes through the fixing device as a recording medium, the front edge extension of the separation member moves away from the nip to suppress a streaked image formed when the front edge extension of the separation member scratches a toner image on the recording medium or a stained background formed when toner adhered from the recording medium to the separation member is adhered to the recording medium again while providing a desired separation ability. Thus, the distance between the separation member and the nip is adjusted to the proper value according to the type of the recording medium.

Even when the recording medium is jammed at the nip, the rotation angle position of the separation member is changed to retract the separation member from the nip, that is, the opposing portion at which a second rotary member (e.g., the pressing roller 30 depicted in FIG. 7, 9, or 11) opposes a first rotary member (e.g., the fixing roller 20 depicted in FIG. 7, 9, or 11). As a result, the user can remove the jammed recording medium easily.

The separation member is rotatively provided on a rotary shaft (e.g., the rotary shaft 200 depicted in FIG. 7, 9, or 11) of the first rotary member and/or a rotary shaft (e.g., the rotary shaft 300 depicted in FIG. 11) of the second rotary member. Accordingly, even when the separation member moves in a circumferential direction of the first rotary member or the second rotary member to change the rotation angle position of the separation member, the relative position between the separation member and the first rotary member or the second rotary member provided with the separation member in a radial direction of the first rotary member or the second rotary member is retained. Consequently, a gap between the front edge extension of the separation member and a surface of the first rotary member or the second rotary member is retained constantly to prevent accidental fluctuation of the separation ability of the separation member to provide the separation ability stably.

For example, in the fixing device 19S depicted in FIG. 9, a contact member (e.g., the contact members 49 depicted in FIG. 10) provided on the separation member contacts the first rotary member to retain the relative position between the separation member and the first rotary member, retaining the gap between the front edge extension of the separation member and the surface of the first rotary member precisely and providing the separation ability of the separation member more stably.

Referring to FIGS. 1 to 13, the following describes effects provided by a fixing device (e.g., the fixing device 19, 19S, or 19T depicted in FIG. 7, 9, or 11, respectively) in detail.

In the fixing device, a pair of rotary members (e.g., the fixing roller 20 and the pressing roller 30 depicted in FIG. 7, 9, or 11) is disposed opposite each other to form a nip (e.g., the nip N depicted in FIG. 7, 9, or 11) between the rotary members. The pair of rotary members applies heat and pressure to fix a toner image on a recording medium as the recording medium passes through the nip. A separation member (e.g., the separation plate 43, 43S, or 43A and 43B depicted in FIG. 7, 9, or 11, respectively) is rotatively provided on a rotary shaft (e.g., the rotary shaft 200 depicted in FIG. 7, 9, or 11 or the rotary shaft 300 depicted in FIG. 11) of one of the rotary members to separate the recording medium passing through the nip from the rotary member. A rotation angle adjuster (e.g., the rotation angle adjuster 46 depicted in FIG. 7 or 9 or the rotation angle adjuster 46T depicted in FIG. 11) changes the rotation angle position of the separation member.

The separation member is rotatively provided on the rotary shaft of the rotary member. Accordingly, even when the separation member moves in a circumferential direction of the rotary member to change the rotation angle position of the separation member, the relative position of the separation member with respect to the rotary member provided with the separation member is retained in a radial direction of the rotary member, preventing accidental fluctuation of the separation ability of the separation member in accordance with movement of the separation member in the circumferential direction of the rotary member.

A recording medium type detector (e.g., the recording medium type detector CP depicted in FIG. 1) is operatively connected to the rotation angle adjuster to detect characteristics (e.g., type) of the recording medium to generate a recording medium type detection signal. The rotation angle adjuster changes the rotation angle position of the separation member based on the recording medium type detection signal provided by the recording medium type detector.

The rotation angle position of the separation member is changed according to the type of the recording medium to adjust the distance between a front edge extension (e.g., the front edge extension 430 depicted in FIG. 7 or 9 or the front edge extension 430A or 430B depicted in FIG. 11) of the separation member and the nip. Thus, the separation member provides the proper fixing property according to the type of the recording medium.

A pressure adjuster (e.g., the pressure adjuster 80 depicted in FIG. 2) moves at least one of the pair of rotary members with respect to another one of the rotary-members according to the type of the recording medium detected by the recording medium type detector to change pressure applied at the nip by the rotary members.

Pressure applied at the nip is changed according to the type of the recording medium to fix the toner image on the recording medium by applying pressure corresponding to the type of the recording medium at the nip. The separation member is provided on the rotary shaft of the rotary member. Therefore, even when the rotary member provided with the separation member is moved, the relative distance between the rotary member and the separation member in the radial direction of the rotary member is retained to prevent accidental fluctuation of the separation ability of the separation member.

The pressure adjuster moves at least one of the pair of rotary members with respect to another one of the rotary members to switch the position of the rotary members between a contact position (e.g., a nip formation position) at which the one of the rotary members contacts the another one of the rotary members and a non-contact position at which the one of the rotary members does not contact the another one of the rotary members.

When the recording medium is jammed at the nip, the rotary members move to the non-contact position at which the rotary members separate from each other, facilitating removal of the recording medium by the user. The separation member is provided on the rotary shaft of the rotary member. Accordingly, even when the rotary member provided with the separation member is moved, the relative distance between the rotary member and the separation member in the radial direction of the rotary member is retained, preventing accidental fluctuation of the separation ability of the separation member.

A jam detector (e.g., the jam detector 70 depicted in FIG. 2) detects the recording medium jammed at the nip. The rotation angle adjuster changes the rotation angle position of the separation member according to a detection signal provided by the jam detector to move the separation member away from the nip, that is, an opposing portion at which the rotary members oppose each other.

The separation member moves away from the opposing portion at which the rotary members oppose each other based on the detection signal provided by the jam detector when the jam detector detects the jammed recording medium. Thus, the separation member is retracted from the nip so that the separation member does not hinder removal of the jammed recording medium by the user, facilitating removal of the jammed recording medium.

The rotation angle adjuster includes a rotation gear (e.g., the rotation gear 47 depicted in FIG. 7 or 9 or the rotation gear 47A or 47B depicted in FIG. 11) and a transmission gear (e.g., the transmission gear 48 depicted in FIG. 7 or 9 or the transmission gear 48A or 48B depicted in FIG. 11). The rotation gear is rotatively mounted on the rotary shaft of the rotary member and is provided with the separation member. The transmission gear engages the rotation gear to transmit a driving force generated by a driver (e.g., the driver M depicted in FIG. 7 or 9 or the driver MT depicted in FIG. 11) to the rotation gear. A moving route (e.g., the moving route J depicted in FIG. 13) on which one of the pair of rotary members mounted with the rotation gear moves with respect to another one of the rotary members draws an arc shape formed about a center of the transmission gear.

The moving route on which the rotary member moves draws an arc formed about the center of the transmission gear. Accordingly, when the rotary member moves, the rotation gear moves along a set of gears of the transmission gear. In other words, even when the rotary member moves, the rotation gear engages the transmission gear constantly. Accordingly, the transmission gear starts rotating at a time when the rotary member is at an arbitrary position to change the rotation angle position of the separation member. When the transmission gear is stopped, the rotation gear rotates along the stopped transmission gear while the rotation gear moves as the rotary member moves. Thus, the rotation angle position of the separation member is changed. In other words, even when the transmission gear does not rotate, the separation member interlocked with the rotary member moves in accordance with movement of the rotary member to change the rotation angle position of the separation member.

When one of the pair of rotary members moves with respect to another one of the rotary members so that the one of the rotary members does not contact the another one of the rotary members, the rotation gear rotates along the stopped transmission gear to move the separation member away from the opposing portion at which the rotary members oppose each other.

Accordingly, the separation member retracts from the opposing portion at which the rotary members oppose each other in accordance with movement of the one of the rotary members moving away from the another one of the rotary members. In other words, even when the driver is not driven, the separation member retracts from the opposing portion at which the rotary members oppose each other, saving energy.

A rotation detector (e.g., the first sensor 51 and the second sensor 52 depicted in FIG. 7 or 9) detects the rotation angle position of the separation member. The rotation angle adjuster is controlled based on a detection signal provided by the rotation detector.

Accordingly, the rotation angle position of the separation member is detected precisely to improve accuracy of changing the rotation angle position.

A rotation support (e.g., the rotation support 44, 44S, or 44A and 44B depicted in FIG. 7, 9, or 11, respectively) is rotatively mounted on the rotary shaft of the rotary member to support the separation member. The separation member is swingably mounted on the rotation support in such a manner that the front edge extension of the separation member moves closer to and away from the surface of the rotary member. A contact member (e.g., the contact members 49 depicted in FIG. 10) is provided on the separation member and contacts the surface of the rotary member. The rotation angle adjuster changes the rotation angle position of the rotation support.

The contact member contacts the rotary member to position the separation member with respect to the rotary member, retaining the relative position of the separation member with respect to the rotary member in the radial direction of the rotary member precisely to provide the separation ability of the separation member more stably. The front edge extension of the separation member moves closer to and away from the surface of the rotary member. Accordingly, even when the recording medium enters between the separation member and the rotary member and is jammed between the separation member and the rotary member, the front edge extension of the separation member separates from the rotary member to facilitate removal of the jammed recording medium by the user.

The separation member is rotatively provided on the rotary shaft of each of the pair of rotary members. The rotation angle adjuster changes the rotation angle position of each of the separation members.

The separation member is provided on each of the pair of rotary members to separate the recording medium from each of the pair of rotary members. The separation member is rotatively provided on the rotary shaft of each of the pair of rotary members. Accordingly, even when the separation member moves in the circumferential direction of the rotary member to change the rotation angle position of the separation member, the relative position of the separation member with respect to the rotary member provided with the separation member is retained in the radial direction of the rotary member, preventing accidental fluctuation of the separation ability of the separation member in accordance with movement of the separation member in the circumferential direction of the rotary member.

The fixing device according to the present invention is not limited to the above-described fixing devices using the electromagnetic induction heating. For example, the fixing device may include only a halogen heater as a heat source. Alternatively, an endless belt may be looped over at least one of the pair of rotary members. Further, according to the above-described example embodiments, the fixing device is installed in the image forming apparatus (e.g., the image forming apparatus 1 depicted in FIG. 1) that functions as a tandem color copier. Alternatively, the fixing device may be installed in other copier, a printer, a facsimile machine, a multifunction printer having at least one of copying, printing, facsimile, and scanning functions, or the like.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A fixing device, comprising:

a first rotary member rotatively disposed on a rotary shaft;

a second rotary member disposed opposite the first rotary member to form a nip between the first rotary member and the second rotary member through which a recording medium bearing a toner image passes;

a first separation member rotatively provided on the rotary shaft of the first rotary member to separate the recording medium passing through the nip from the first rotary member;

a recording medium type detector to detect characteristics of the recording medium to generate a recording medium type detection signal;

a pressure adjuster operatively connected to the recording medium type detector to move at least one of the first rotary member and the second rotary member based on the recording medium type detection signal provided by the recording medium type detector to change pressure between the first rotary member and the second rotary member at the nip; and a rotation angle adjuster connected to the first separation member to change a rotation angle position of the first separation member, wherein the rotation angle adjuster includes:

a driver to generate a driving force;

a rotation gear rotatively mounted on the rotary shaft of the first rotary member and connected to the first separation member; and a transmission gear to engage the rotation gear and connected to the driver to transmit the driving force generated by the driver to the rotation gear, and wherein the first rotary member mounted with the rotation gear moves in an arc about a center of the transmission gear with respect to the second rotary member.

2. The fixing device according to claim 1, wherein the recording medium type detector is operatively connected to the rotation angle adjuster to detect characteristics of the recording medium to generate a recording medium type detection signal, and wherein the rotation angle adjuster changes the rotation angle position of the first separation member based on the recording medium type detection signal provided by the recording medium type detector.

3. The fixing device according to claim 1, further comprising a rotation detector operatively connected to the rotation angle adjuster to detect the rotation angle position of the first separation member to generate a rotation angle detection signal, wherein the rotation angle adjuster changes the rotation angle position of the first separation member based on the rotation angle detection signal provided by the rotation detector.

4. The fixing device according to claim 1, further comprising:

a front edge extension of the first separation member;

a rotation support rotatively mounted on the rotary shaft of the first rotary member and mounted with the first separation member to swingably support the first separation member to move the front edge extension of the first separation member closer to and away from the first rotary member; and a contact member mounted on the first separation member to contact a surface of the first rotary member, wherein the rotation angle adjuster changes a rotation angle position of the rotation support.

5. The fixing device according to claim 1, further comprising a second separation member rotatively provided on a rotary shaft of the second rotary member, wherein the rotation angle adjuster changes the rotation angle position of each of the first separation member and the second separation member.

6. A fixing device, comprising:

a first rotary member rotatively disposed on a rotary shaft;

a second rotary member disposed opposite the first rotary member to form a nip between the first rotary member and the second rotary member through which a recording medium bearing a toner image passes;

a first separation member rotatively provided on the rotary shaft of the first rotary member to separate the recording medium passing through the nip from the first rotary member;

a rotation angle adjuster connected to the first separation member to change a rotation angle position of the first separation member;

a pressure adjuster to move at least one of the first rotary member and the second rotary member to switch a position of the first rotary member and the second rotary member between a contact position and a non-contact position, wherein at the contact position the second rotary member contacts the first rotary member to form the nip between the first rotary member and the second rotary member, and at the non-contact position the second rotary member does not contact the first rotary member; and a jam detector operatively connected to the rotation angle adjuster to detect jamming of the recording medium at the nip and generate a jam detection signal, wherein the rotation angle adjuster changes the rotation angle position of the first separation member based on the jam detection signal provided by the jam detector to move the first separation member away from the nip.

7. The fixing device according to claim 6, further comprising a recording medium type detector operatively connected to the rotation angle adjuster to detect characteristics of the recording medium to generate a recording medium type detection signal, wherein the rotation angle adjuster changes the rotation angle position of the first separation member based on the recording medium type detection signal provided by the recording medium type detector.

8. The fixing device according to claim 6, further comprising a rotation detector operatively connected to the rotation angle adjuster to detect the rotation angle position of the first separation member to generate a rotation angle detection signal, wherein the rotation angle adjuster changes the rotation angle position of the first separation member based on the rotation angle detection signal provided by the rotation detector.

9. The fixing device according to claim 6, further comprising:

a front edge extension of the first separation member;

a rotation support rotatively mounted on the rotary shaft of the first rotary member and mounted with the first separation member to swingably support the first separation member to move the front edge extension of the first separation member closer to and away from the first rotary member; and a contact member mounted on the first separation member to contact a surface of the first rotary member, wherein the rotation angle adjuster changes a rotation angle position of the rotation support.

10. The fixing device according to claim 6, further comprising a second separation member rotatively provided on a rotary shaft of the second rotary member, wherein the rotation angle adjuster changes the rotation angle position of each of the first separation member and the second separation member.

11. A fixing device, comprising:

a first rotary member rotatively disposed on a rotary shaft;

a second rotary member disposed opposite the first rotary member to form a nip between the first rotary member and the second rotary member through which a recording medium bearing a toner image passes;

a first separation member rotatively provided on the rotary shaft of the first rotary member to separate the recording medium passing through the nip from the first rotary member;

a pressure adjuster to move at least one of the first rotary member and the second rotary member to switch a position of the first rotary member and the second rotary member between a contact position and a non-contact position, wherein at the contact position the second rotary member contacts the first rotary member to form the nip between the first rotary member and the second rotary member, and at the non-contact position the second rotary member does not contact the first rotary member; and a rotation angle adjuster connected to the first separation member to change a rotation angle position of the first separation member, wherein the rotation angle adjuster includes:

a driver to generate a driving force;

a rotation gear rotatively mounted on the rotary shaft of the first rotary member and connected to the first separation member; and a transmission gear to engage the rotation gear and connected to the driver to transmit the driving force generated by the driver to the rotation gear, wherein the first rotary member mounted with the rotation gear moves in an arc about a center of the transmission gear with respect to the second rotary member, and wherein the rotation gear rotates along the stopped transmission gear to move the first separation member away from the nip when the pressure adjuster moves at least one of the first rotary member and the second rotary member to the non-contact position.

12. The fixing device according to claim 11, further comprising a recording medium type detector operatively connected to the rotation angle adjuster to detect characteristics of the recording medium to generate a recording medium type detection signal, wherein the rotation angle adjuster changes the rotation angle position of the first separation member based on the recording medium type detection signal provided by the recording medium type detector.

13. The fixing device according to claim 11, further comprising a rotation detector operatively connected to the rotation angle adjuster to detect the rotation angle position of the first separation member to generate a rotation angle detection signal, wherein the rotation angle adjuster changes the rotation angle position of the first separation member based on the rotation angle detection signal provided by the rotation detector.

14. The fixing device according to claim 11, further comprising:

a front edge extension of the first separation member;

a rotation support rotatively mounted on the rotary shaft of the first rotary member and mounted with the first separation member to swingably support the first separation member to move the front edge extension of the first separation member closer to and away from the first rotary member; and a contact member mounted on the first separation member to contact a surface of the first rotary member, wherein the rotation angle adjuster changes a rotation angle position of the rotation support.

15. The fixing device according to claim 11, further comprising a second separation member rotatively provided on a rotary shaft of the second rotary member, wherein the rotation angle adjuster changes the rotation angle position of each of the first separation member and the second separation member.

16. An image forming apparatus comprising:

a fixing device, including:

a first rotary member rotatively disposed on a rotary shaft;

a second rotary member disposed opposite the first rotary member to form a nip between the first rotary member and the second rotary member through which a recording medium bearing a toner image passes;

a first separation member rotatively provided on the rotary shaft of the first rotary member to separate the recording medium passing through the nip from the first rotary member;

a rotation angle adjuster connected to the first separation member to change a rotation angle position of the first separation member;

a recording medium type detector to detect characteristics of the recording medium to generate a recording medium type detection signal; and a pressure adjuster operatively connected to the recording medium type detector to move at least one of the first rotary member and the second rotary member based on the recording medium type detection signal provided by the recording medium type detector to change pressure between the first rotary member and the second rotary member at the nip, wherein the rotation angle adjuster includes:

a driver to generate a driving force;

a rotation gear rotatively mounted on the rotary shaft of the first rotary member and connected to the first separation member; and a transmission gear to engage the rotation gear and connected to the driver to transmit the driving force generated by the driver to the rotation gear, and wherein the first rotary member mounted with the rotation gear moves in an arc about a center of the transmission gear with respect to the second rotary member.

17. The image forming apparatus according to claim 16, wherein the recording medium type detector is operatively connected to the rotation angle adjuster to detect characteristics of the recording medium to generate a recording medium type detection signal, wherein the rotation angle adjuster changes the rotation angle position of the first separation member based on the recording medium type detection signal provided by the recording medium type detector.

18. The image forming apparatus to claim 16, wherein the fixing device further comprises a rotation detector operatively connected to the rotation angle adjuster to detect the rotation angle position of the first separation member to generate a rotation angle detection signal, and wherein the rotation angle adjuster changes the rotation angle position of the first separation member based on the rotation angle detection signal provided by the rotation detector.

19. The image forming apparatus according to claim 16, wherein the fixing device further comprises:

a front edge extension of the first separation member;

a rotation support rotatively mounted on the rotary shaft of the first rotary member and mounted with the first separation member to swingably support the first separation member to move the front edge extension of the first separation member closer to and away from the first rotary member; and a contact member mounted on the first separation member to contact a surface of the first rotary member, and wherein the rotation angle adjuster changes a rotation angle position of the rotation support.

20. The image forming apparatus according to claim 16, wherein the fixing device further comprises a second separation member rotatively provided on a rotary shaft of the second rotary member, and wherein the rotation angle adjuster changes the rotation angle position of each of the first separation member and the second separation member.

21. An image forming apparatus comprising:

a fixing device, including:

a first rotary member rotatively disposed on a rotary shaft;

a second rotary member disposed opposite the first rotary member to form a nip between the first rotary member and the second rotary member through which a recording medium bearing a toner image passes;

a first separation member rotatively provided on the rotary shaft of the first rotary member to separate the recording medium passing through the nip from the first rotary member;

a rotation angle adjuster connected to the first separation member to change a rotation angle position of the first separation member;

a pressure adjuster to move at least one of the first rotary member and the second rotary member to switch a position of the first rotary member and the second rotary member between a contact position and a non-contact position, wherein at the contact position the second rotary member contacts the first rotary member to form the nip between the first rotary member and the second rotary member, and at the non-contact position the second rotary member does not contact the first rotary member; and a jam detector operatively connected to the rotation angle adjuster to detect jamming of the recording medium at the nip and generate a jam detection signal, wherein the rotation angle adjuster changes the rotation angle position of the first separation member based on the jam detection signal provided by the jam detector to move the first separation member away from the nip.

22. The image forming apparatus according to claim 21, wherein the fixing device further comprises a recording medium type detector operatively connected to the rotation angle adjuster to detect characteristics of the recording medium to generate a recording medium type detection signal, and wherein the rotation angle adjuster changes the rotation angle position of the first separation member based on the recording medium type detection signal provided by the recording medium type detector.

23. The image forming apparatus to claim 21, wherein the fixing device further comprises a rotation detector operatively connected to the rotation angle adjuster to detect the rotation angle position of the first separation member to generate a rotation angle detection signal, and wherein the rotation angle adjuster changes the rotation angle position of the first separation member based on the rotation angle detection signal provided by the rotation detector.

24. The image forming apparatus according to claim 21, wherein the fixing device further comprises:

a front edge extension of the first separation member;

a rotation support rotatively mounted on the rotary shaft of the first rotary member and mounted with the first separation member to swingably support the first separation member to move the front edge extension of the first separation member closer to and away from the first rotary member; and a contact member mounted on the first separation member to contact a surface of the first rotary member, and wherein the rotation angle adjuster changes a rotation angle position of the rotation support.

25. The image forming apparatus according to claim 21, wherein the fixing device further comprises a second separation member rotatively provided on a rotary shaft of the second rotary member, and wherein the rotation angle adjuster changes the rotation angle position of each of the first separation member and the second separation member.

26. An image forming apparatus comprising:

a fixing device, including:

a first rotary member rotatively disposed on a rotary shaft;

a second rotary member disposed opposite the first rotary member to form a nip between the first rotary member and the second rotary member through which a recording medium bearing a toner image passes;

a first separation member rotatively provided on the rotary shaft of the first rotary member to separate the recording medium passing through the nip from the first rotary member;

a pressure adjuster to move at least one of the first rotary member and the second rotary member to switch a position of the first rotary member and the second rotary member between a contact position and a non-contact position, wherein at the contact position the second rotary member contacts the first rotary member to form the nip between the first rotary member and the second rotary member, and at the non-contact position the second rotary member does not contact the first rotary member; and a rotation angle adjuster connected to the first separation member to change a rotation angle position of the first separation member, wherein the rotation angle adjuster includes:

a driver to generate a driving force;

a rotation gear rotatively mounted on the rotary shaft of the first rotary member and connected to the first separation member; and a transmission gear to engage the rotation gear and connected to the driver to transmit the driving force generated by the driver to the rotation gear, wherein the first rotary member mounted with the rotation gear moves in an arc about a center of the transmission gear with respect to the second rotary member, and wherein the rotation gear rotates along the stopped transmission gear to move the first separation member away from the nip when the pressure adjuster moves at least one of the first rotary member and the second rotary member to the non-contact position.

27. The image forming apparatus according to claim 26, wherein the fixing device further comprises a recording medium type detector operatively connected to the rotation angle adjuster to detect characteristics of the recording medium to generate a recording medium type detection signal, and wherein the rotation angle adjuster changes the rotation angle position of the first separation member based on the recording medium type detection signal provided by the recording medium type detector.

28. The image forming apparatus to claim 26, wherein the fixing device further comprises a rotation detector operatively connected to the rotation angle adjuster to detect the rotation angle position of the first separation member to generate a rotation angle detection signal, and wherein the rotation angle adjuster changes the rotation angle position of the first separation member based on the rotation angle detection signal provided by the rotation detector.

29. The image forming apparatus according to claim 26, wherein the fixing device further comprises:

a front edge extension of the first separation member;

a rotation support rotatively mounted on the rotary shaft of the first rotary member and mounted with the first separation member to swingably support the first separation member to move the front edge extension of the first separation member closer to and away from the first rotary member; and a contact member mounted on the first separation member to contact a surface of the first rotary member, and wherein the rotation angle adjuster changes a rotation angle position of the rotation support.

30. The image forming apparatus according to claim 26, wherein the fixing device further comprises a second separation member rotatively provided on a rotary shaft of the second rotary member, and wherein the rotation angle adjuster changes the rotation angle position of each of the first separation member and the second separation member.

* * * * *